US007442406B2

(12) United States Patent
Terada et al.

(10) Patent No.: US 7,442,406 B2
(45) Date of Patent: Oct. 28, 2008

(54) ELECTRON-EMITTING DEVICE, ELECTRON SOURCE SUBSTRATE, ELECTRON BEAM APPARATUS, DISPLAY APPARATUS, AND MANUFACTURING METHOD THEREOF

(75) Inventors: Masahiro Terada, Kanagawa (JP); Yasuko Tomida, Kanagawa (JP); Makoto Kojima, Kanagama (JP); Tsuyoshi Furuse, Kanagawa (JP); Taku Shimoda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 603 days.

(21) Appl. No.: 11/260,395

(22) Filed: Oct. 28, 2005

(65) Prior Publication Data

US 2006/0057279 A1 Mar. 16, 2006

Related U.S. Application Data

(62) Division of application No. 10/253,931, filed on Sep. 25, 2002, now Pat. No. 6,992,434.

(30) Foreign Application Priority Data

Sep. 27, 2001 (JP) ..... 2001/295337
Sep. 13, 2002 (JP) ..... 2002/267607

(51) Int. Cl.
*B05D 5/12* (2006.01)
*B05D 3/02* (2006.01)
*B05D 1/02* (2006.01)

(52) U.S. Cl. ..... 427/77; 427/380; 427/421.1

(58) Field of Classification Search ..... 427/77, 427/379–380, 421.1, 427.4
See application file for complete search history.

(56) References Cited

U.S. PATENT DOCUMENTS

| | | | | |
|---|---|---|---|---|
| 5,455,597 | A | 10/1995 | Nakamura et al. | 345/75 |
| 5,659,329 | A | 8/1997 | Yamanobe et al. | 345/74 |
| 6,034,478 | A | 3/2000 | Kawade et al. | 315/169.1 |
| 6,063,453 | A | 5/2000 | Tomida et al. | 427/532 |
| 6,113,448 | A | 9/2000 | Kobayashi et al. | 445/24 |
| 6,137,218 | A | 10/2000 | Kaneko et al. | 313/495 |
| 6,259,191 | B1 | 7/2001 | Mitome et al. | 313/310 |
| 6,283,813 | B1 | 9/2001 | Kaneko et al. | 455/24 |
| 6,296,896 | B1 | 10/2001 | Takahashi et al. | 427/77 |
| 6,334,801 | B1 | 1/2002 | Kawade et al. | 445/24 |

(Continued)

FOREIGN PATENT DOCUMENTS

EP 0936 652 A1 8/1999

(Continued)

*Primary Examiner*—Katherine A. Bareford
*Assistant Examiner*—Jimmy Lin
(74) *Attorney, Agent, or Firm*—Fitzpatrick, Cella, Harper & Scinto

(57) ABSTRACT

An electron-emitting device comprises a pair of opposing electrodes formed on a substrate, an electroconductive film having a fissure arranged between the pair of electrodes, and at least a film having a gap and containing carbon as a main ingredient, arranged at an end portion of the electroconductive film facing the fissure.

The fissure is a region of 95% or more of a length in the fissure direction, has a width of from 60 nm or more to 800 nm or less, and has a difference of 300 nm or less between a maximum value and a minimum value of the width, thereby providing high withstanding voltage without forming branched fissure.

1 Claim, 13 Drawing Sheets

U.S. PATENT DOCUMENTS

| | | | | |
|---|---|---|---|---|
| 6,380,665 | B1 | 4/2002 | Motoi et al. | 313/310 |
| 6,586,872 | B2 | 7/2003 | Shibata | 313/495 |

FOREIGN PATENT DOCUMENTS

| | | |
|---|---|---|
| JP | 64-31332 | 2/1989 |
| JP | 6-342636 | 12/1994 |
| JP | 7-326311 | 12/1995 |
| JP | 8-185818 | 7/1996 |
| JP | 9-50757 | 2/1997 |
| JP | 9-102271 | 4/1997 |
| JP | 9-298029 | 11/1997 |
| JP | 2000-251665 | 9/2000 |

ELECTRON-EMITTING DEVICE, ELECTRON SOURCE SUBSTRATE, ELECTRON BEAM APPARATUS, DISPLAY APPARATUS, AND MANUFACTURING METHOD THEREOF

This application is a division of U.S. application Ser. No. 10/253,931, filed Sep. 25, 2002, now U.S. Pat. No. 6,992,434.

BACKGROUND OF THE INVENTION

1. Field of the Invention

The present invention relates to an electron-emitting device and an image forming apparatus such as a display apparatus using the electron-emitting device as an electron source, and more particularly to discharge suppression of a surface conduction electron-emitting device.

2. Related Background Art

Up to now, there have been known two types of electron-emitting devices, a thermoelectron type and a cold cathode type. Of these, the cold cathode type includes a field emission type device (FE device), a metal/insulating layer/metal type device (MIM device), a surface conduction electron-emitting device (SCE device), and the like.

The SCE device includes an electron-emitting device in which an electroconductive film having a fissure is connected to a pair of opposing electrodes arranged on a substrate. The electron-emitting device is realized by utilizing a phenomenon that: energization processing called forming is previously conducted to the electroconductive film to be locally broken, deformed, or altered, thereby forming an electrically high-resistance portion having a fissure; then, a voltage is applied between device electrodes to make a current parallel to the surface of the electroconductive film flow; and thus, electron emission occurs from the fissure and/or an electron-emitting portion in the periphery thereof.

As to documents of the prior art relating to the above, device formation in which an electroconductive film is formed using an ink jet apparatus is described in detail in JP 09-102271 A and JP 2000-251665 A, and an example in which the above-mentioned devices are arranged in a XY matrix shape is described in detail in JP 64-031332 A, JP 07-326311 A, and the like. Further, a wiring formation method is described in detail in JP 08-185818 A and JP 09-050757 A, and a driving method is described in detail in JP 06-342636 A and the like.

The electron-emitting portion of the above-mentioned electron-emitting device is arranged at the electrically high-resistance portion including the fissure as described above, and a film containing carbon as a main ingredient is preferably formed at an end portion of the electroconductive film facing the fissure in order to raise efficiency of electron emission.

A process of forming the film containing carbon as a main ingredient is called an activation process. The activation process can be conducted, for example, by repeating application of a pulse between a pair of device electrodes under an atmosphere containing gas comprised of an organic substance. The surface conduction electron-emitting device obtained through the above is disclosed in, for example, JP 09-298029 A.

The above-mentioned electron-emitting device is greatly expected as an electron-emitting device with high efficiency. However, since the electron-emitting portion is formed by energization processing in forming, there is a large variation in the form of the fissure portion. In particular, there occurs a discharge phenomenon of a device which derives from nonuniformity of a fissure width, and thus, there has been a situation in which the manufacture of the electron-emitting device with high reliability is difficult to be conducted.

There will be described below the discharge phenomenon of a device which derives from nonuniformity of a fissure width of the electroconductive film.

FIGS. 13A and 13B are enlarged diagrams (conceptual diagrams) each showing an electron-emitting portion. FIG. 13A is a schematic diagram of a fissure portion after a forming process, and FIG. 13B is a schematic diagram of a fissure portion (a fissure of the electroconductive film and a gap of a film containing carbon as a main ingredient) after an activation process. In each of the figures, the upper part is a plan view, and the lower part is a sectional view.

As described above, as to the formation of the electron-emitting portion, first, energization is conducted to the electroconductive film in the forming process (FIG. 13A), and further, the film containing carbon as a main ingredient is formed at the end portion of the electroconductive film facing the fissure in the activation process. At this time, it is expected that heat generation at several hundreds to one thousand degrees is developed in the fissure portion, and simultaneously with the deposition of carbon, there occurs variation of the fissure position of the electroconductive film due to deformation or evaporation of the electroconductive film (FIG. 13B).

FIG. 13B is an enlarged diagram of the portion with a fissure width of 10 to 100 nm and the whole size of approximately 1 μm or less. However, the size of the actual electroconductive film is generally several tens to several hundreds of μm.

Further, in terms of the display device, several thousands to several millions of devices are provided.

The fissure formation by energization is conducted in the forming process as described above. Thus, in addition to the form shown in FIG. 13B, there may be a case shown in FIG. 14 where there are formed a portion with a wide width, an island-shape remainder material of the fissure, and a portion that branches out from the main line of the fissure. Even if deposition of the film containing carbon as a main ingredient is conducted to the electroconductive film in such a fissure state in the activation process, the island-shape remainder material and the branched portion are left as they are without being largely changed in shape.

In the study made by the present inventors, the discharge phenomenon in electron emission is easily to occur in the above-mentioned electron-emitting device, and the upper limit of the voltage capable of being applied in activation is lowered. Further, also in the case where after the subsequent stabilization process such as vacuum heating, the electron-emitting device is driven in a vacuum envelope, the upper limit of the voltage for driving without discharge is lowered. Thus, a desired electron emission current cannot be obtained. Alternatively, in the case where the voltage with which the desired electron emission current can be obtained is continuously applied, a device discharge may be caused, and thus, the electron-emitting device may be broken.

SUMMARY OF THE INVENTION

The present invention has been made in order to solve the above-mentioned problem in the prior art, and therefore has an object to provide an electron-emitting device with high efficiency which suppresses a device discharge and an image forming apparatus using the electron-emitting device and to provide a manufacturing method thereof.

In order to solve the above-mentioned problems, according to a first aspect of the present invention, there is provided an electron-emitting device comprising: a pair of opposing electrodes formed on a substrate; an electroconductive film having a fissure arranged between the pair of electrodes; and at least a film having a gap and containing carbon as a main ingredient, arranged at an end portion of the electroconductive film facing the fissure, characterized in that the fissure is a region of 95% or more of a length in the fissure direction; has a width of from 60 nm or more to 800 nm or less; and has a difference of 300 nm or less between a maximum value and a minimum value of the width.

Further, according to another aspect of the present invention, an electron-emitting device comprising: a pair of facing electrodes formed on a substrate; an electroconductive film having a fissure arranged between the pair of electrodes; and at least a film having a gap and containing carbon as a main ingredient, arranged at an end portion of the electroconductive film facing the fissure, characterized in that the width of the fissure is 20 nm or more greater than the gap.

Still further, according to another aspect of the present invention, there is provided an electron-emitting device comprising: a pair of facing electrodes formed on a substrate; an electroconductive film having a fissure arranged between the pair of electrodes; and at least a film having a gap and containing carbon as a main ingredient, arranged at an end portion of the electroconductive film facing the fissure, characterized in that: the fissure is a region of 95% or more of a length in the fissure direction; has a width of from 60 nm or more to 800 nm or less; and has a difference of 300 nm or less between a maximum value and a minimum value of the width, and that the width of the fissure is 20 nm or more greater than the gap.

Yet further, the above-mentioned inventions may include as preferred embodiments thereof the following characteristics: the electroconductive film has a film thickness of 12 nm or less in a region of 80% or more of the length of the electroconductive film in the fissure direction except for both end portions thereof, and has a difference of 4 nm or less between a maximum value and a minimum value of the film thickness;

the electroconductive film has a film thickness of 10 nm or less in a region of 80% or more of the length of the electroconductive film in the fissure direction except for both end portions thereof, and has a difference of 3 nm or less between a maximum value and a minimum value of the film thickness;

the electroconductive film contains as a main ingredient palladium or platinum; and the film containing carbon as a main ingredient comprises one of graphite, amorphous carbon and a mixture thereof.

Here, "except both end portions in the fissure direction" means that, in the case where the thickness of the electroconductive film is measured substantially along the fissure, both the end portions are portions where the electroconductive film ends, that is, where the thickness sharply becomes zero, and thus, both the end portions are excluded.

According to further another aspect of the present invention to solve the above-mentioned problems, there is provided a method of manufacturing an electron-emitting device comprising: a pair of facing electrodes formed on a substrate; an electroconductive film having a fissure arranged between the pair of electrodes; and at least a film having a gap and containing carbon as a main ingredient, arranged at an end portion of the electroconductive film facing the fissure, the method comprising: at least a liquid drop applying process for liquid drop-applying electroconductive film ingredient-containing liquid containing the ingredient of the electroconductive film, characterized in that in the liquid drop applying process, the liquid drop applying is conducted at a plurality of times for one portion one after another, and wherein at every interval between the respective plurality of liquid drop applying processes for applying the liquid drop for portion one after another, 96 wt % to 99 wt % based on 100 wt % of a solvent contained in the liquid drop is evaporated.

In addition, the above-mentioned invention may include as preferred embodiments thereof the following characteristics: the electroconductive film ingredient-containing liquid is an aqueous solution which contains at least a metal element and an organic metal complex compound containing an amino acid group or an amino alcohol group;

the metal element contains at least palladium or platinum as a main component;

the amount of the metal element contained in the aqueous solution is in a range of from 0.1 to 1.0% by weight;

the organic metal complex compound is either a palladium-proline complex or a palladium acetate-ethanol amine complex;

the aqueous solution contains a partially-esterified polyvinyl alcohol;

the aqueous solution contains a soluble polyvalent alcohol;

the amount of soluble polyvalent alcohol contained in the aqueous solution is in a range of from 0.2 to 3.0% by weight;

the soluble polyvalent alcohol is a polyvalent alcohol having 2 to 4 carbon atoms;

the soluble polyvalent alcohol is one selected from the group consisting of ethylene glycol, propylene glycol and glycerin;

the aqueous solution contains a monovalent alcohol;

in the liquid drop applying process, the electroconductive film ingredient-containing liquid is used as the aqueous solution and contains:

a palladium-proline complex in a palladium element concentration of 0.1 to 0.5% by weight; a partially-esterified polyvinyl alcohol in a concentration of 0.05 to 0.5% by weight; ethylene glycol, propylene glycol or a mixture thereof in a concentration of 0.2 to 3.0% by weight; a monovalent alcohol in a concentration of 0 to 30% by weight;

the intervals between each drop-applying process conducted a plurality of times per space is controlled so as to be 2 to 10 seconds;

the electroconductive film region of 80% or more of a length of the electroconductive film in the fissure direction except for both end portions has a thickness of 12 nm or less and a difference of 4 nm or less between a maximum value and a minimum value of the thickness;

the electroconductive film region of 80% or more of a length of the electroconductive film in the fissure direction except for both end portions has a thickness of 10 nm or less and a difference of 3 nm or less between the maximum value and the minimum value of the thickness; and an ink jet apparatus is used as the liquid drop applying means for applying a liquid drop.

Yet further another aspect of the present invention to solve the above-mentioned problems, there is provided an electron source substrate comprising a plurality of electron-emitting devices arranged on the substrate, characterized in that the electron-emitting devices are the electron-emitting device according to the present invention described above.

Yet further another aspect of the present invention to solve the above-mentioned problems, there is provided an electron beam apparatus including an electron-emitting device in an envelope, characterized in that the electron-emitting device is the electron-emitting device according to the present invention.

Yet further another aspect of the present invention to solve the above-mentioned problems, there is provided a display device comprising an electron source provided with an electron-emitting device and means for applying an electric voltage to the electron-emitting device and a phosphor that emits light upon receiving an electron radiated from the electron-emitting device, wherein the electron-emitting device is the electron-emitting device according to the present invention.

As described above, there is often seen a case where a micro structure of the form of the fissure included in the electron-emitting portion is generally nonuniform, which leads to an electron-emitting device in which a discharge phenomenon is easy to occur. However, according to the detailed observation result of the fissure form in which the discharge occurs, which is obtained by the present inventors, it is found that in the fissure portion where the discharge occurs: the fissure width of the electroconductive film is small; the film containing carbon as a main ingredient does not sufficiently cover the electroconductive film; or the possibility that the island-shape remainder material of the electroconductive film exists is extremely high.

In the above-mentioned case, the element withstand voltage at the time of driving was 15 to 16V.

On the contrary, in the case where the film containing carbon as a main ingredient covers the fissure surface of the electroconductive film to form a gap over the device, and the electroconductive film has a certain distance from the position of the gap, the withstand voltage of the device is approximately 19 to 23V. Thus, there can be obtained an electron-emitting device having sufficient performance including reliability with respect to a driving voltage (about 14 to 16V) set for obtaining an electron emission current necessary for an electron-emitting device used for, for example, a display apparatus.

BRIEF DESCRIPTION OF THE DRAWINGS

FIG. 10 is a conceptual diagram of an example of an electron source using an electron source substrate with a simple matrix arrangement and an image forming apparatus used for display and the like;

DETAILED DESCRIPTION OF THE PREFERRED EMBODIMENTS

Figure 13A:
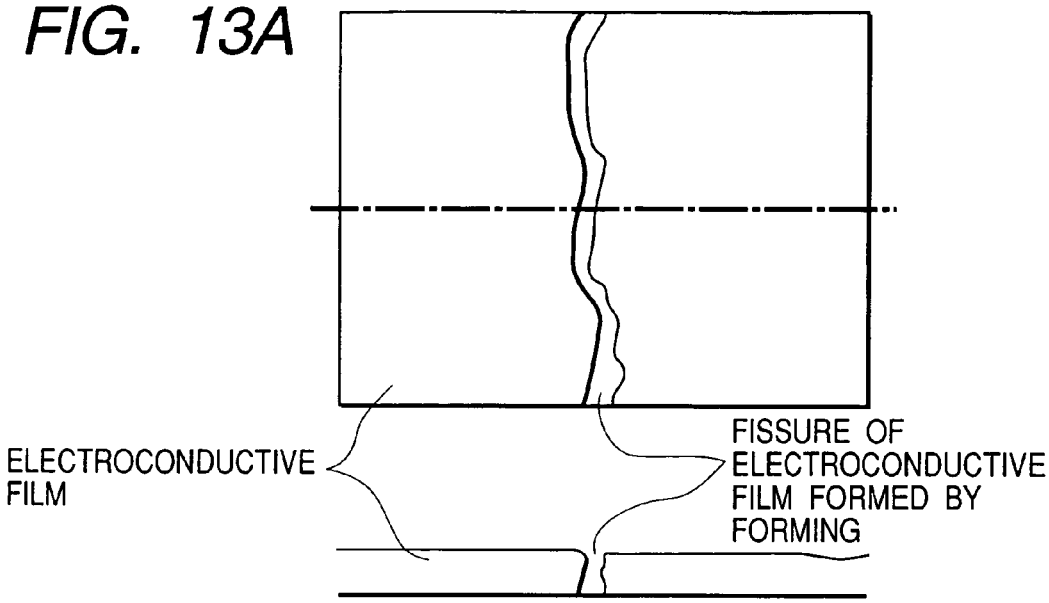
FIGS. 13A and 13B are conceptual diagrams each showing an enlarged diagram of an electron-emitting portion.
Figure 13B:
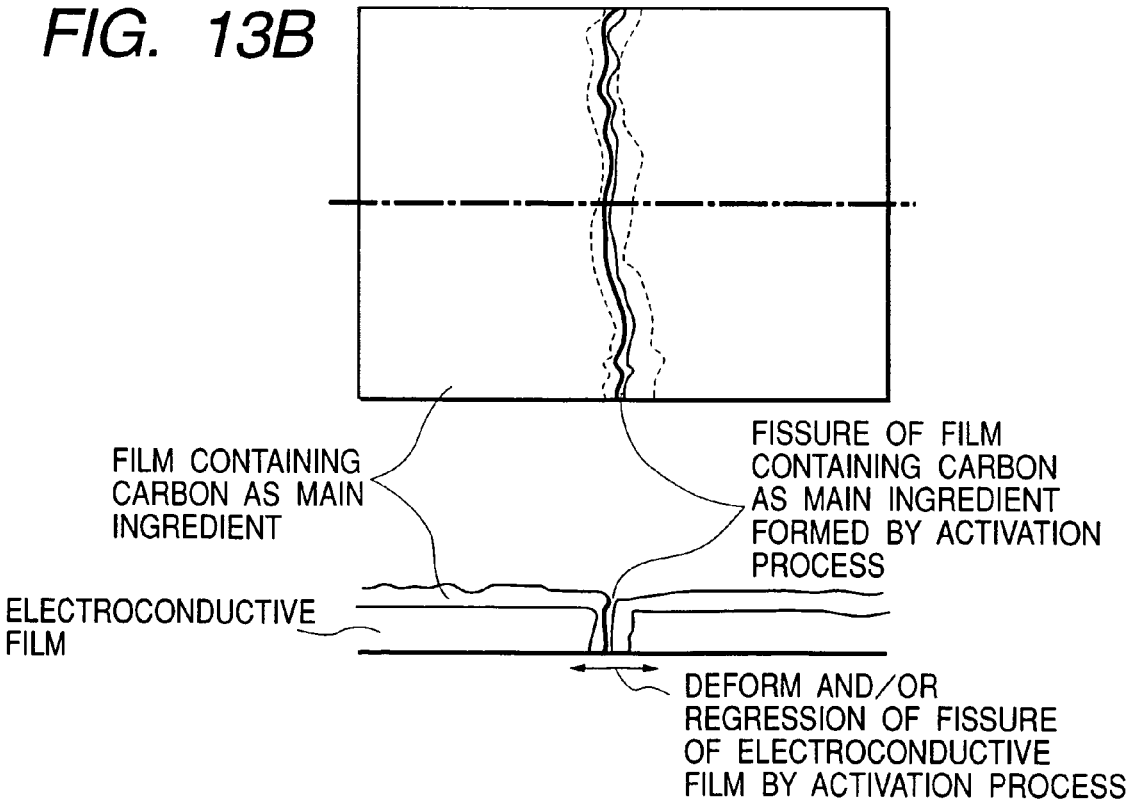
Figure 14:
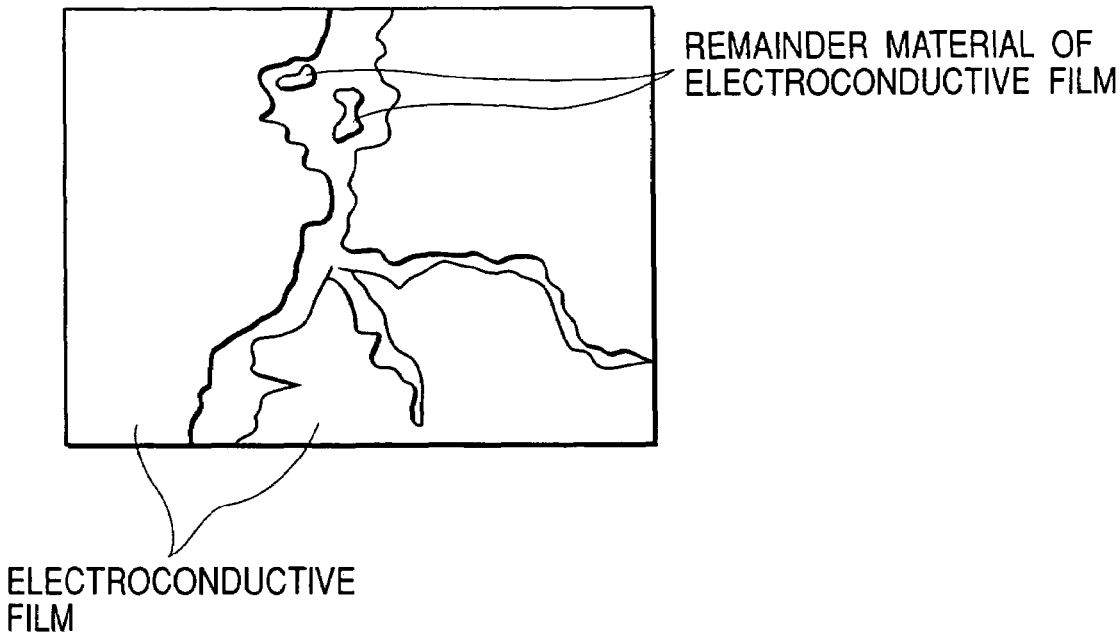
FIG. 14 is a conceptual diagram showing an enlarged diagram of an electron-emitting portion.

According to the detailed examination made by the present inventors, it is found that the size of the gap in the film containing carbon as a main ingredient (distance between the film containing carbon as a main ingredient and the film containing carbon as a main ingredient, inner width in FIG. 13B) shows the satisfactory electron source characteristic at about several nm to 40 nm although depending on the activation voltage, and in the case where the distance between the position of the gap (inner width in FIG. 13B) and the end portion of the electroconductive film (outer fissure in FIG. 13B) is at least +10 nm or more, the above-mentioned high withstand voltage device is obtained. When this is defined in terms of the fissure width, it can be said that the fissure width is 60 nm or more.

Further, the present inventors have confirmed, in the case of the electron-emitting device in which the fissure width of the electroconductive film is larger than the gap in the carbon film by 20 nm or more, even in the device having the gap in the carbon film outside the above-mentioned range of several nm to 40 nm, the device characteristic does not change over a long period (the life of the device is long). Note that it is particularly preferable that the fissure width of the electroconductive film is larger than the gap in the carbon film by no less than 20 nm and below 100 nm.

Further, the above-mentioned case where the fissure has a branched portion has been the factor in reduction of the device withstand voltage. However, in the case where the fissure of the electroconductive film region of 95% or more of the length in the fissure direction is uniform and has a fissure width of not less than 60 nm and below 800 nm and a difference of 300 nm or less between the maximum value and the minimum value of the fissure width, there can be obtained the electron-emitting device with no branched portion and with a high device withstand voltage.

Further, the high voltage activation process is applied by utilizing the high withstand voltage, whereby the electron-emitting device with higher efficiency compared with a general case can be obtained.

The following is rephrased; the film containing carbon as a main ingredient covers the fissure surface of the electroconductive film, the fissure of the electroconductive film region of 95% or more of the length in the fissure direction has a fissure width of not less than 60 nm and below 800 nm and a difference of 300 nm or less between the maximum value and the minimum value of the fissure width. The electron-emitting device in which the fissure of the conductive film has a uniform width is finally determined in its form in the activation process, and thus, in a process of forming a fissure by forming, the necessary condition is that a uniform fissure is formed without a branched portion and a region having a width of several hundreds of nm or more although depending on the process conditions (an application voltage, an organic compound material of a carbon source, a concentration thereof, and a gas concentration in an atmosphere of another substance). The form of the fissure which is extended (for example, 100 nm or more) at the time of the fissure formation by forming hinders the activation, and thus, the satisfactory electron source characteristic cannot be obtained in many cases.

As the extremely effective means for the uniform fissure formation by forming, there is given "the electroconductive film that contains palladium or platinum as a main ingredient". Further, as characteristics thereof, there are given:

the electroconductive film region of 80% or more of a length of the electroconductive film in the fissure direction except for both end portions has a thickness of 12 nm or less and a difference of 4 nm or less between a maximum value and a minimum value of the thickness; and the electroconductive film region of 80% or more of a length of the electroconductive film in the fissure direction except for both end portions has a thickness of 10 nm or less and a difference of 3 nm or less between the maximum value and the minimum value of the thickness.

Further, as the effective means for forming the level electroconductive film, the following is given in which: in a method of manufacturing an electron-emitting device including: a pair of facing electrodes formed on a substrate; an electroconductive film having a fissure and arranged between the pair of electrodes; and at least a film having a gap and containing carbon as a main ingredient, arranged at an end portion of the electroconductive film facing the fissure, the method includes: at least a liquid drop applying process of liquid drop-applying electroconductive film ingredient-containing liquid containing the ingredient of the electroconductive film;

in the liquid drop applying process, the liquid drop application is conducted plural times for one portion, 96 wt % to 99 wt % based on 100 wt % of a solvent contained in the liquid drop is evaporated at every interval between each of the liquid drop application that is conducted plural times for one portion one after another;

the electroconductive film ingredient-containing liquid is an aqueous solution which contains at least a metal element and an organic metal complex compound containing an amino acid group or an amino alcohol group;

the metal element contains at least palladium or platinum as a main component;

the amount of the metal element contained in the aqueous solution is in a range of from 0.1 to 1.0% by weight;

the organic metal complex compound is either a palladium-proline complex or a palladium acetate-ethanol amine complex;

the aqueous solution contains a partially-esterified polyvinyl alcohol;

the aqueous solution contains a soluble polyvalent alcohol;

the amount of soluble polyvalent alcohol contained in the aqueous solution is in a range of from 0.2 to 3.0% by weight;

the soluble polyvalent alcohol is a polyvalent alcohol having 2 to 4 carbon atoms;

the soluble polyvalent alcohol is one selected from the group consisting of ethylene glycol, propylene glycol and glycerin;

the aqueous solution contains a monovalent alcohol;

in the liquid drop applying process, the electroconductive film ingredient-containing liquid is used as the aqueous solution and contains:

a palladium-proline complex in a palladium element concentration of 0.1 to 0.5% by weight; a partially-esterified polyvinyl alcohol in a concentration of 0.05 to 0.5% by weight; ethylene glycol, propylene glycol or a mixture thereof in a concentration of 0.2 to 3.0% by weight; a monovalent alcohol in a concentration of 0 to 30% by weight;

the intervals between each drop-applying process conducted a plurality of times for one portion is controlled so as to be 2 to 10 seconds;

Embodiments (Electron-Emitting Device)

A specific embodiment of an electron-emitting device according to the present invention will be described with reference to the conceptual diagram of FIGS. 1A and 1B.

Figure 1A:
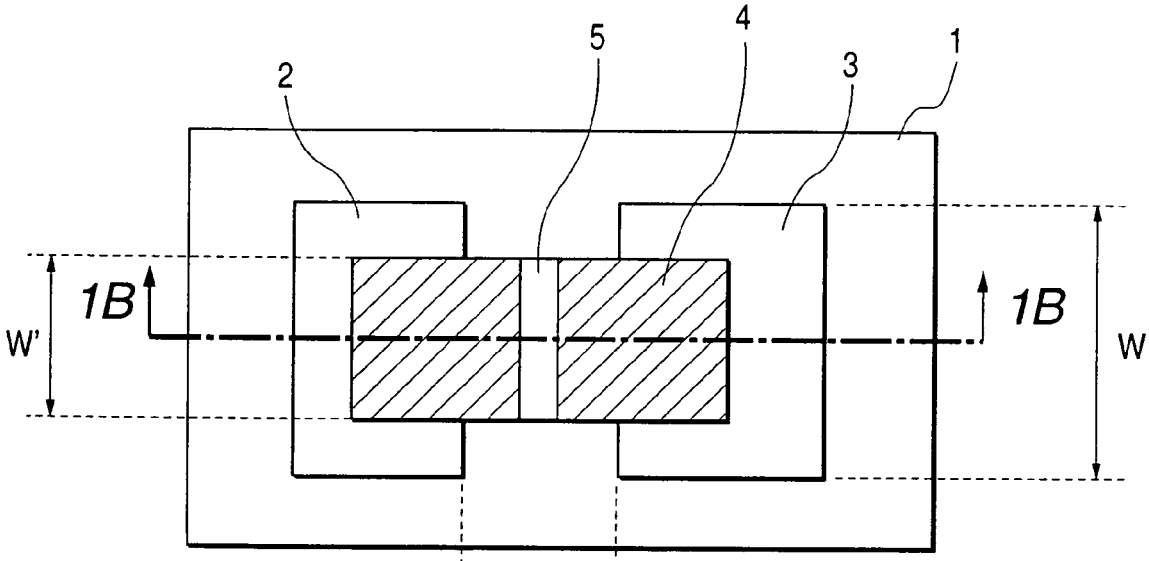
FIGS. 1A and 1B are conceptual diagrams showing an example of an electron-emitting device.
Figure 1B:
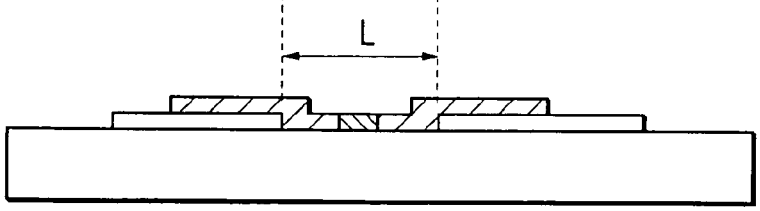

In FIGS. 1A and 1B, reference numeral 1 denotes a glass substrate corresponding to a substrate, reference numerals 2 and 3 denote device electrodes corresponding to electrodes, and reference numeral 4 denotes an electroconductive film having a fissure, which is connected with the device electrodes 2 and 3. Further, reference numeral 5 denotes an electron-emitting portion including the fissure formed in the electroconductive film 4. The present invention has a characteristic in this fissure.

That is, according to the present invention, it is characterized in that a fissure region of 95% or more of a length in the fissure direction has a fissure width of from 60 nm to 800 nm and a difference of 300 nm or less between a maximum value and a minimum value of the fissure width.

The electron-emitting device having such a fissure has no branched fissure and has a high withstand voltage. Further, a high voltage activation process is applied thereto by utilizing its high pressure-resistance, whereby an electron-emitting device with higher efficiency compared with a general case can be obtained.

Here, the length in the fissure direction indicates, for example, the length corresponding to W' in FIG. 1A, that is, the length in the fissure forming direction substantially perpendicular to the fissure width direction. Note that, for the convenience in the figure, the shape of the electroconductive film 4 is rectangular in FIG. 1A, but in the case where the electroconductive film is formed by liquid application using an ink jet apparatus which is described below, the shape is substantially circular. Further, although the electron-emitting portion 5 having a rectangular shape is shown in the center portion of the electroconductive film 4, this is schematically shown, and thus, the actual position and shape of the electron-emitting portion are not shown realistically.

A glass substrate is often used as a substrate. The size and thickness are appropriately set depending on the number of electron-emitting device structures provided on the substrate and the layout shape of each electron-emitting device and also dynamic conditions such as an atmospheric pressure-resistance structure for keeping an envelope in vacuum in the case where a part of the vacuum envelope is constituted at the time of the use of an electron source.

Inexpensive soda lime glass is generally used as the material of glass. However, there needs to be used a substrate in which a silicon oxide film with a thickness of approximately 0.5 μm is formed as a sodium blocking layer by sputtering on the soda lime glass, or the like. In addition, a substrate formed of glass containing little sodium content or a quartz substrate may be adopted.

On the other hand, as the material of the device electrodes 2 and 3, general conductive materials are used, for example, metals such as Ni, Cr, Au, Mo, Pt, Ru, and Ti, and metals such as Pd—Ag are preferably used. Otherwise, the material is appropriately selected from a printed conductor constructed by an oxide metal and glass etc., a transparent conductive member such as indium tin oxide (ITO), and the like, and the film thickness thereof is preferably in a range of from 10 nm to several μm.

The interval between device electrodes L, the device electrode length W, the shape of the device electrodes 2 and 3, and the like at this time are appropriately designed in accordance with the mode to which the electron-emitting device is applied, and the like. The interval L is preferably about several hundreds of nm to 1 mm, and more preferably, 1 μm to 100 μm in consideration for a voltage applied between the device electrodes, and the like. Further, the device electrode length W is preferably several μM to several hundreds of μm in consideration for a resistance value of the electrode and an electron-emitting characteristic.

Further, the device electrode can be formed by application of a paste containing metal particles such as platinum (Pt) on the market by a printing method such as offset printing.

Further, with the purpose of obtaining a more precise pattern, the device electrode can be formed by a process of: applying a photosensitive paste containing Pt or the like by a printing method such as screen printing; and conducting exposure and developing thereto with the use of a photo mask.

The thickness of the electroconductive film is appropriately set in consideration for the process coverage to the device electrodes 2 and 3, the resistance value between the device electrodes, forming processing conditions described below, also, a discharge pressure-resistance of the electron-emitting device that is an object of the present invention, and the like.

Note that in addition to the structures shown in FIGS. 1A and 1B, there may be adopted a structure in which the electroconductive film 4 and the opposing device electrodes 2 and 3 are laminated on the substrate 1 in this order.

As examples of the materials which constitute the electroconductive film 4 include: metals such as Pd, Pt, Ru, Ag, Au, Ti, In, Cu, Cr, Fe, Zn, Sn, Ta, W, and Pb; oxides such as Pd, O, $SnO_2$, $In_2O_3$, $Sb_2O_3$; borides such as $HfB_2$, $ZrB_2$, $LaB_6$, $CeB_6$, $YB_4$, and $GdB_4$; carbonates such as TiC, ZrC, HfC, TaC, SiC and WC; nitrides such as TiN, Zrn, and Hfn; semiconductors such as Si and Ge; carbons etc.; and furthermore, mixtures thereof.

According to the study made by the applicants of the present invention, from the viewpoint of controlling the fissure width described below, a material containing palladium (Pd) or platinum (Pt) as a main ingredient is especially appropriate as the material for the electroconductive film. Further, the electroconductive film region of 80% or more of a length of the electroconductive film in the fissure direction except for both end portions has a thickness of 12 nm or less and a difference of 4 nm or less between a maximum value and a minimum value of the thickness, and more preferably a thickness of 10 nm or less and a difference of 3 nm or less between the maximum value and the minimum value of the thickness.

In the case where a PdO film is formed using a material containing palladium Pd as a main ingredient, energization heating is conducted under a reducing atmosphere where hydrogen coexists with palladium, and a palladium Pd film and a fissure portion can be simultaneously formed. However, even if a hydrogen atmosphere is not used, the fissure portion can be formed only by energization.

There may be a case where an atmosphere is kept at a certain degree of vacuum and a case where heating is conducted at approximately 50° C. to 120° C. for supporting reduction and fissure formation.

The fissure portion constitutes the electron-emitting portion 5. In order to raise the efficiency of electron emission, it is preferable that processing called an activation process is conducted.

The activation process is a process of forming a film containing carbon as a main ingredient in the electron-emitting fissure portion. For example, the activation process can be conducted by repeating application of a pulse voltage between the device electrodes 2 and 3 under an atmosphere containing gas comprised of an organic substance.

At this time, it is preferable that the film containing carbon as a main ingredient comprises graphite, amorphous carbon, or a mixture thereof since degassing from the film can be suppressed to attain a longer life.

(Manufacturing Method)

A specific embodiment of a method of manufacturing an electron-emitting device according to the present invention will be described with reference to plan views of FIGS. 2A to 4E showing processes in forming electron-emitting devices in matrix. Incidentally, the present invention is not limited to this embodiment.

Note that a method of manufacturing an electron source substrate is given in the following description in order to avoid wordiness. The characteristic of the present invention resides in a liquid drop applying process that is described with reference to FIG. 4E, and the method of manufacturing an electron-emitting device of the present invention is a manufacturing method at least including the process E. That is, in manufacturing an electron-emitting device as a single element, there may be omitted a process of forming X directional wirings and Y directional wirings which connect the large number of electron-emitting devices, which is described below.

In FIGS. 2A to 4E, reference numeral 21 denotes a glass substrate, 22 and 23 denote device electrodes, 24 denotes Y directional wirings, 25 denotes an insulating film, 26 denotes X directional wirings, 27 denotes an electroconductive film in which an electron-emitting portion (not shown) is formed.

(A) Formation of Device Electrode

Figure 2A:
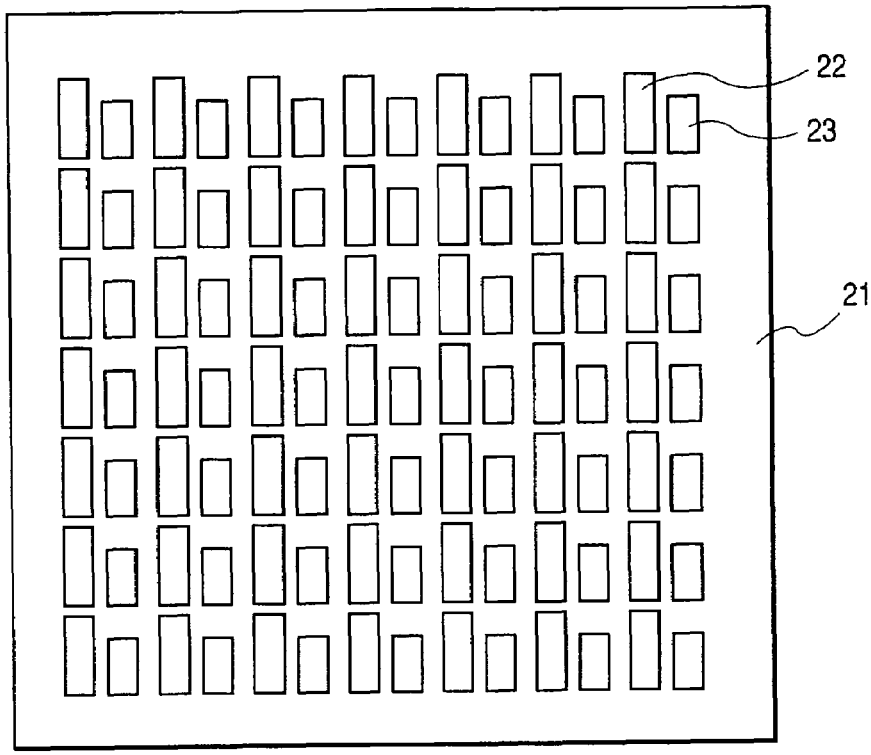
FIGS. 2A and 2B are plan views showing processes in forming electron-emitting devices in matrix.

The device electrodes 22 and 23 are formed on the glass substrate 21 (FIG. 2A). The material and shape preferably used for the above-mentioned components are as described above in the embodiment of the electron-emitting device.

(B) Formation of Y Directional Wirings

Figure 2B:
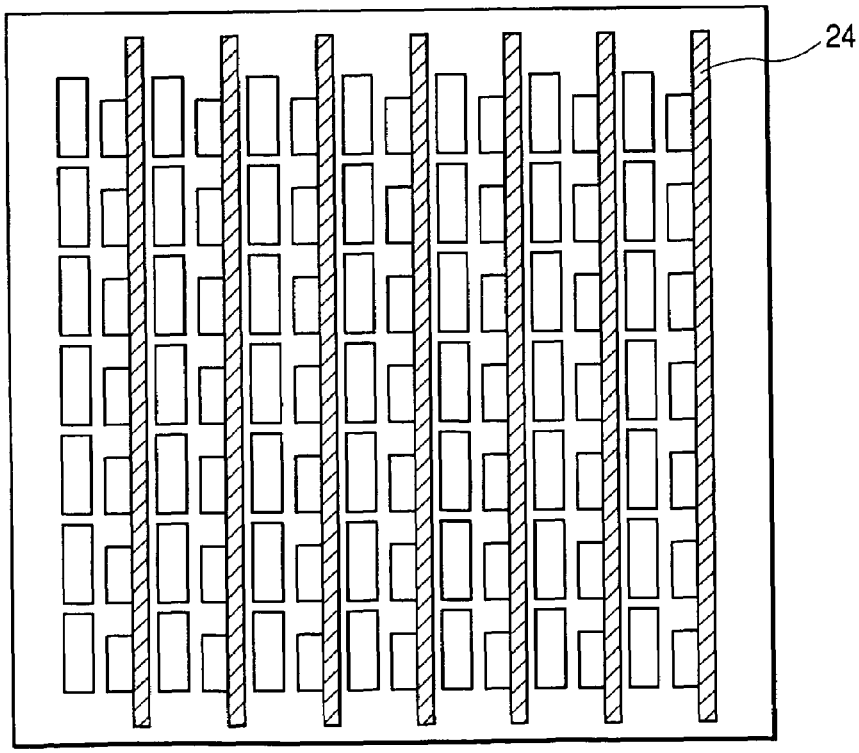

The Y directional wirings 24 (lower wirings) are simply and easily formed in a line-shape pattern so as to contact and connect with the device electrodes 23 corresponding to one kind of the device electrodes (FIG. 2B). For example, the wirings can be formed by using a method in which: screen printing is conducted using photo paste ink containing metal; then, drying is conducted thereto; exposure and developing are conducted with a predetermined pattern; and then, baking is conducted thereto.

The material for the wirings desirably has low resistance in order that a substantially uniform voltage is supplied to a large number of surface conduction devices. The material, thickness, width, and the like of the wiring are appropriately set. It is preferable that: Ag, Cu, Pd, Fe, Ni, a composite material thereof, or the like is used; the thickness is approximately several μm to several tens of μm; and the wiring width is approximately several tens of μm to several hundreds of μm.

Note that a terminal end portion of the wiring preferably has a large line width since it is used as an electrode for drawing a wiring.

(C) Formation of Insulating Film

In order to establish insulation between upper and lower wirings (Y directional wirings and X directional wirings described below), the insulating film 25 is arranged. In the arrangement shown in FIG. 3C, a contact hole is opened in a connection portion so as to cover at least an intersecting portion of the X directional wiring (upper wiring) described below and the Y directional wiring (lower wiring) that is previously formed under the X directional wiring and so as to enable electrical connection between the upper wiring (X wiring) and the device electrodes of the another kind.

For example, the contact hole can be formed by conducting screen printing with a photosensitive glass paste and then conducting exposure and developing.

Oxides such as PbO, silica, and alumina, a mixture thereof, and the like can be used as the material for the insulating film. The thickness is about several μm to several tens of μm, and the width is fit to the line width of the wiring.

(D) Formation of X Directional Wiring

Figure 3C:
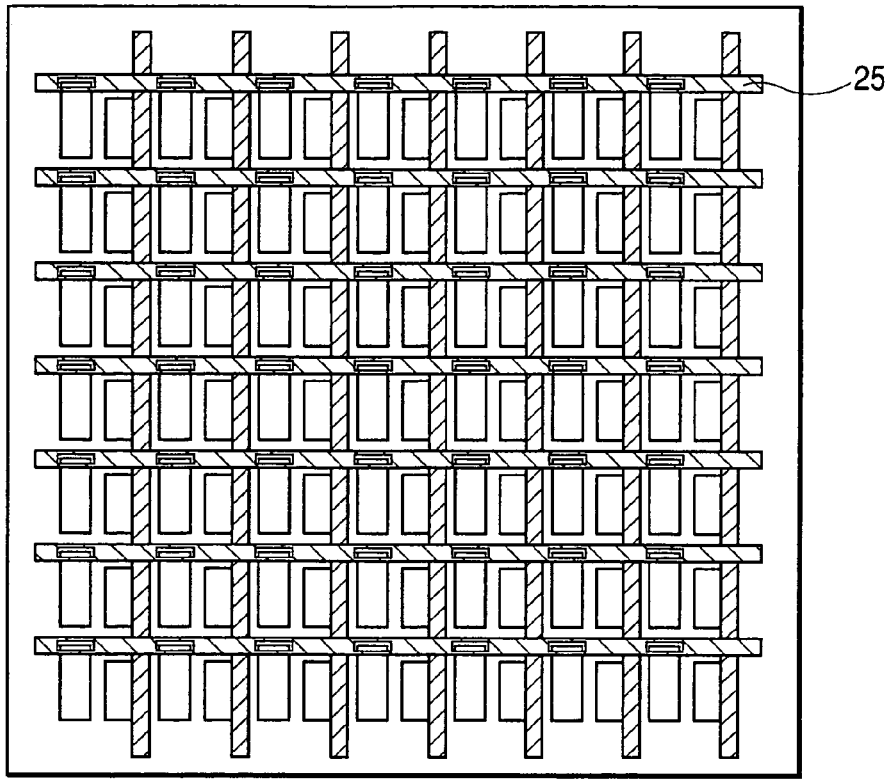
FIGS. 3C and 3D are plan views showing processes in forming electron-emitting devices in matrix.
Figure 3D:
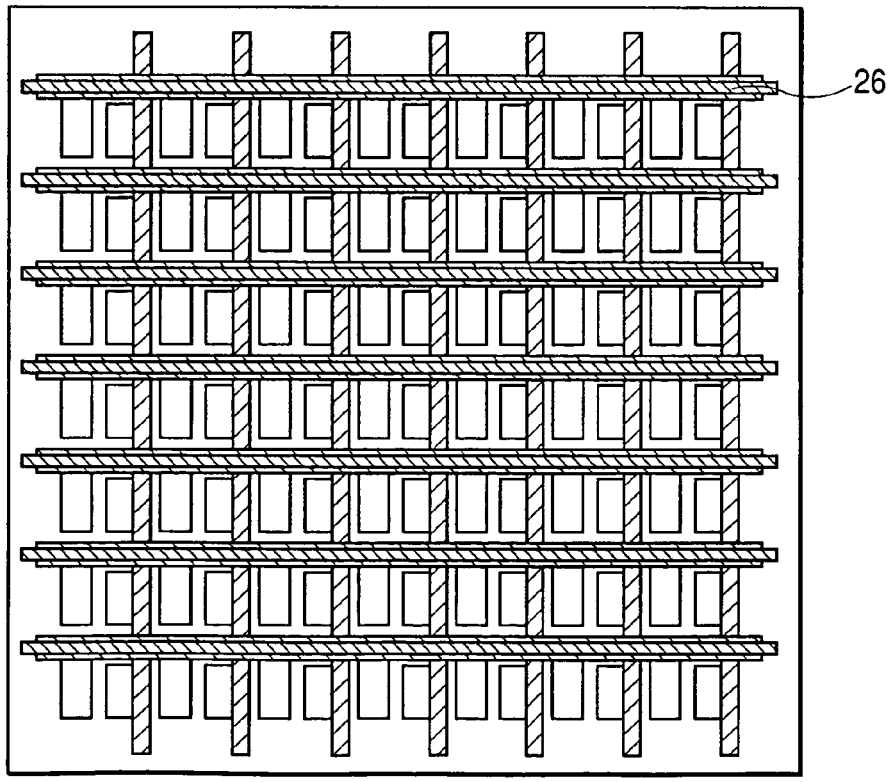

The X directional wirings 26 (upper wirings) are formed on the insulating film 25 that is previously formed (FIG. 3D).

The X directional wirings can be formed as follows. That is, for example, the following is repeated a plurality of times in which: screen printing is conducted with metal paste ink; and then, drying is conducted thereto, and baking is conducted thereto.

The X directional wiring 26 intersects with the Y directional wiring 24 while sandwiching the insulating film 25 therebetween, and is connected to the device electrodes 22 that are not connected with the Y directional wiring at the contact hole portion of the insulating film 25.

The device electrodes 22 are coupled by the X directional wiring. In the case of a display panel, the device electrodes 22 act as scanning electrodes.

Preferred material, thickness, line width, and the like of the wiring are similar to those of the Y directional wiring.

Further, drawing wirings with an external driver circuit can be formed by the same method, and a drawing terminal to the external driver circuit can also be formed by the same method.

As described above, a substrate having X-Y matrix wirings can be formed.

(E) Formation of Electroconductive Film (Including Liquid Drop Applying Process)

Figure 4E:
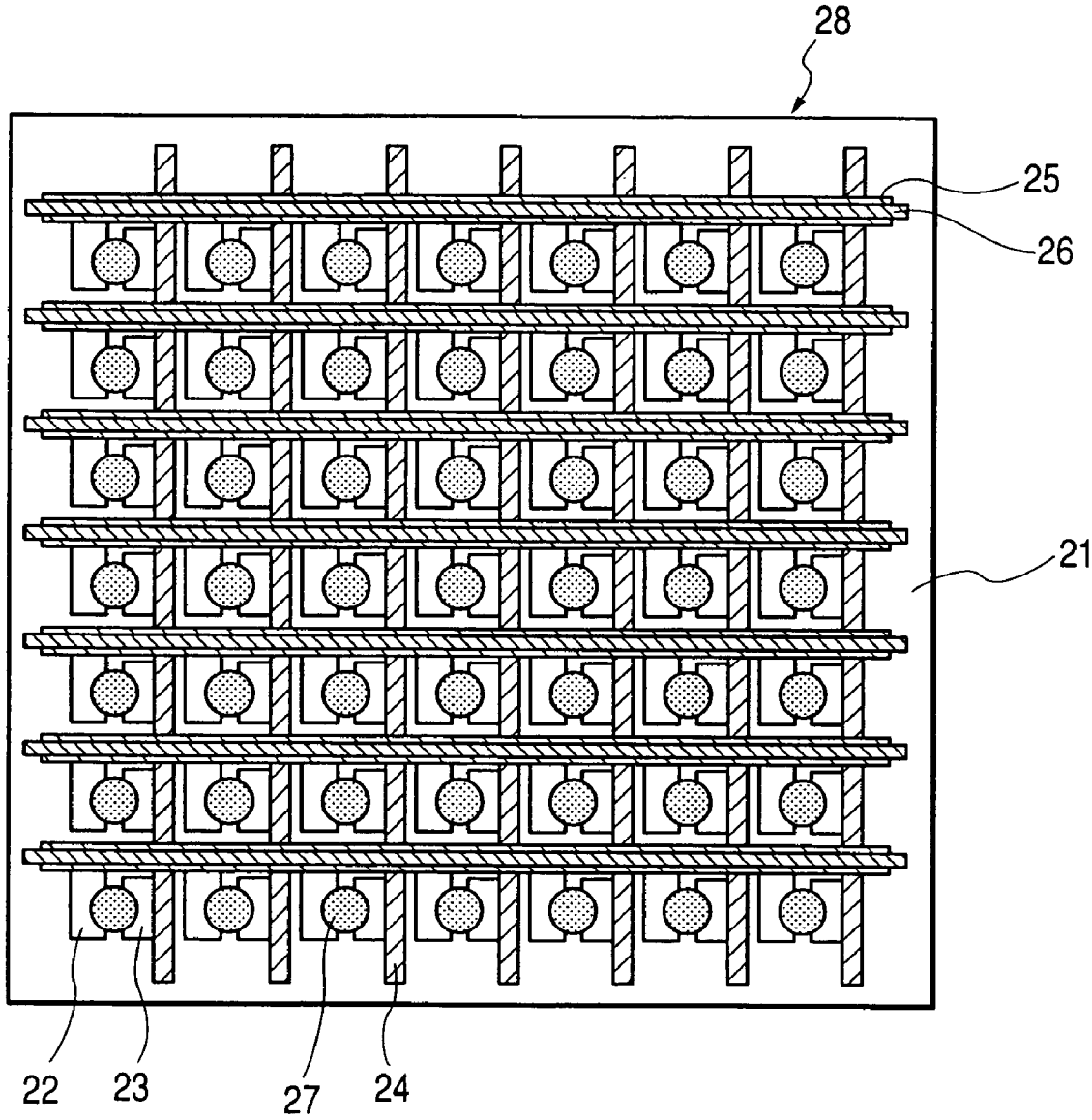
FIG. 4E is a plan view showing a process in forming electron-emitting devices in matrix.

The electroconductive film for forming the electron-emitting portion is formed between the device electrodes (FIG. 4E).

The present invention has a characteristic in a method of forming the electroconductive film. That is, it is characterized in that: this process includes a liquid drop applying process of liquid drop-applying electroconductive film ingredient-containing liquid containing the ingredient of the electroconductive film; and in the liquid drop applying process, the liquid drop application is conducted plural times for one portion, 96 wt % to 99 wt % based on 100 wt % of a solvent contained in the liquid drop is evaporated at every interval between each of the liquid drop application that is conducted plural times for one portion.

As indicated by examinations which are conducted by the applicants of the present invention and are described below, by conducting the liquid drop application in this way, there can be realized a fissure state that enables extremely high uniformity in forming and improvement of performance of the electron-emitting device.

As extremely effective and preferable means for uniform fissure formation with forming, there is given "the electroconductive film containing palladium or platinum as a main ingredient". Further, as characteristics of the means, there are given "the electroconductive film region of 80% or more of a length of the electroconductive film in the fissure direction except for both end portions has a thickness of 12 nm or less and a difference of 4 nm or less between a maximum value and a minimum value of the thickness" and "the electroconductive film region of 80% or more of a length of the electroconductive film in the fissure direction except for both end portions has a thickness of 10 nm or less and a difference of 3 nm or less between the maximum value and the minimum value of the thickness".

Note that "the state having levelness is preferable" indicates "this state immediately before forming is preferable". In the case where the formation of the electroconductive film is completed only by air seasoning, when the electroconductive film is formed by heating and baking followed by the air seasoning, the number of times of liquid drop application, material, and the like are adjusted so as to obtain the levelness after the completion of the heating and baking.

Further, as to the effective means for forming the level electroconductive film, there is preferably provided a method of manufacturing an electron-emitting device including: a pair of facing electrodes formed on a substrate; an electroconductive film having a fissure and arranged between the pair of electrodes; and at least a film having a gap and containing carbon as a main ingredient, arranged at an end portion of the electroconductive film facing the fissure, the method including: at least a liquid drop applying process of liquid drop-applying electroconductive film ingredient-containing liquid containing the ingredient of the electroconductive film, wherein the liquid drop application is conducted plural times for one portion one after another, and 96 wt % to 99 wt % based on 100 wt % of a solvent contained in the liquid drop is evaporated at every interval between each of the liquid drop application that is conducted plural times. In addition, the method preferably has the following characteristics: the electroconductive film ingredient-containing liquid is an aqueous solution which contains at least a metal element and an organic metal complex compound containing an amino acid group or a amino alcohol group; the amount of the metal element contained in the aqueous solution is in a range of from 0.1 to 1.0% by weight; the organic metal complex compound is either a palladium-proline complex or a palladium acetate-ethanol amine complex; the aqueous solution contains a partially-esterified polyvinyl alcohol; the aqueous solution contains a soluble polyvalent alcohol; the amount of soluble polyvalent alcohol contained in the aqueous solution is in a range of from 0.2 to 3.0% by weight; the soluble polyvalent alcohol is a polyvalent alcohol having 2 to 4 carbon atoms; the soluble polyvalent alcohol is one selected from the group consisting of ethylene glycol, propylene glycol and glycerin; and the aqueous solution contains a monovalent alcohol.

More specifically, for example, there is given as a preferred embodiment the following, in which: in the drop-applying process, the electroconductive film ingredient-containing liquid is used as the aqueous solution, and contains: a palladium-proline complex in a palladium element concentration of 0.1 to 0.5% by weight; a partially-esterified polyvinyl alcohol in a concentration of 0.05 to 0.5% by weight; ethylene glycol, propylene glycol or a mixture thereof in a concentration of 0.2 to 3.0% by weight; a monovalent alcohol in a concentration of 0 to 30% by weight, and the intervals between each drop-applying process conducted a plurality of times per space is controlled so as to be 2 to 10 seconds.

Further, it is simple and easy and also preferable to use an ink jet apparatus as a liquid drop applying means for applying a liquid drop. Further, it is preferable that: the ink jet apparatus is of a heating system in which air bubble is formed in a liquid by thermal energy, and a liquid drop is discharged by the pressure of the air bubble; or the ink jet apparatus is of a piezoelectric element system in which dynamic energy that is generated by application of a voltage to a piezoelectric element is utilized to thereby discharge a liquid drop since the use of the apparatus often used enables implementation at low cost and also, since the liquid drop application can be conducted simply and easily. A specific example of the ink jet apparatus of a heating system is Bubble Jet (registered trademark) of Canon Inc.

Figure 5A:
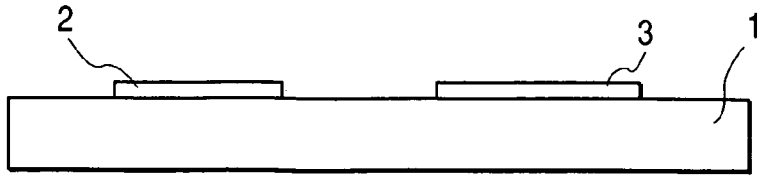
FIGS. 5A, 5B, 5C and 5D are schematic sectional views showing a liquid drop applying process.
Figure 5B:
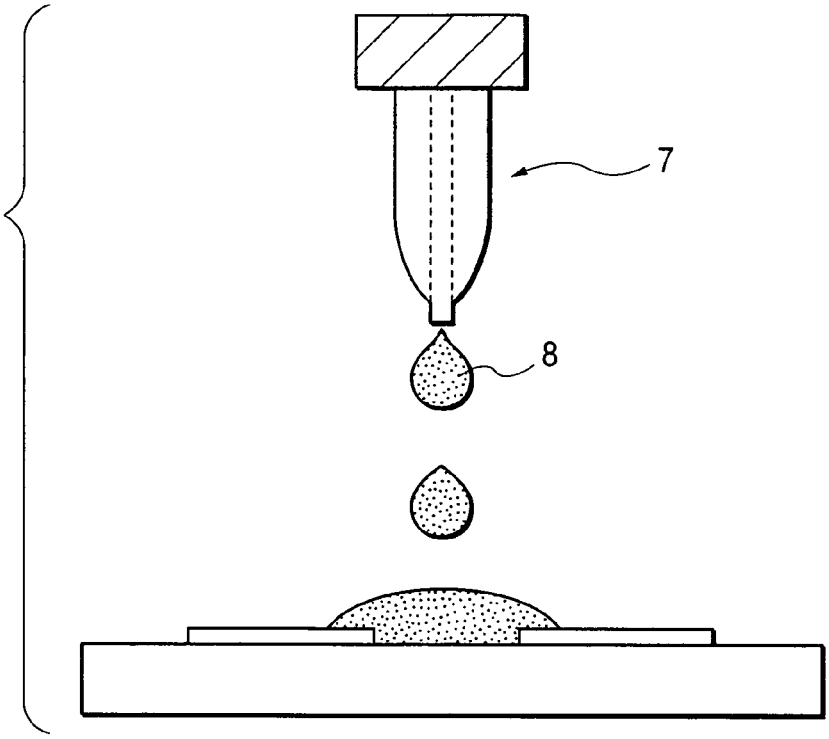
Figure 5C:
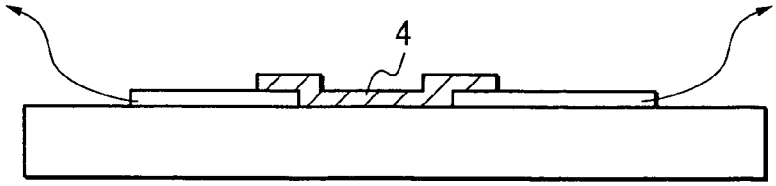
Figure 5D:
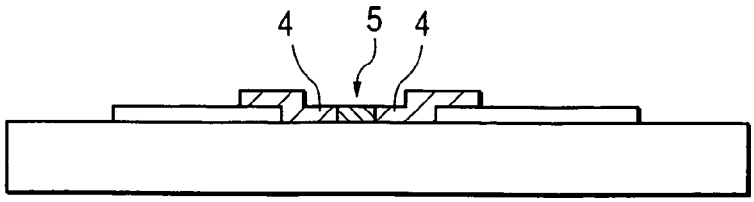

FIGS. 5A to 5C show schematic sectional views of processes of the present invention. In the actual processes, in order to compensate for plane variation of the respective device electrodes on the substrate, it is preferable that: arrangement deviation of a pattern is observed at several points on the substrate; the deviation amounts between the observation points are subjected to interpolation in position so as to be linearly approximate with each other; and application eliminates positional deviation of all pixels and is exactly conducted to a corresponding position.

Note that it is preferable that, prior to the liquid drop applying process, the substrate is sufficiently cleaned, and then, the surface is processed with a solution containing a repellent so as to have appropriate hydrophobic property. This has an aim that the electroconductive film ingredient-containing solution that is liquid drop-applied later is arranged so as to be appropriately expanded over the substrate and the electrodes.

After the completion of the liquid drop application, baking is preferably conducted in an atmosphere at about 300 to 400° C. for about 20 to 60 minutes. In addition, there may be a case where only air seasoning is conducted.

(F) Forming

In this process called forming, the electroconductive film is subjected to energization processing to develop a fissure in the interior, thereby forming the electron-emitting portion.

As a specific method, the following is given, for example. That is, a hood-shape lid is put so as to cover the whole substrate except a drawing electrode portion in the periphery of the substrate to form a vacuum space in the interior between the lid and the substrate, a voltage is applied between X wirings and Y wirings from an external power source through an electrode terminal portion to energize the device electrodes, and thus, the electroconductive film is locally broken, deformed, or altered, whereby the electron-emitting portion in an electrically high-resistance state is formed.

At this time, when energization heating is conducted in a vacuum atmosphere containing a little hydrogen gas, reduction is promoted by hydrogen, and palladium oxide PdO is changed into a palladium Pd film. It is considered that a fissure is generated by not only reduction and contraction of the electroconductive film at the time of this change but also local heat generation due to energization. The generation position of the fissure and the shape are largely influenced by uniformity of the original electroconductive film.

Note that with only the fissure formed by the above-mentioned forming, electron emission occurs at a predetermined voltage, but generation efficiency is very low under the present conditions. Therefore, the activation process described below is preferably conducted.

Next, a voltage waveform used in forming processing is briefly introduced.

Figure 6A:
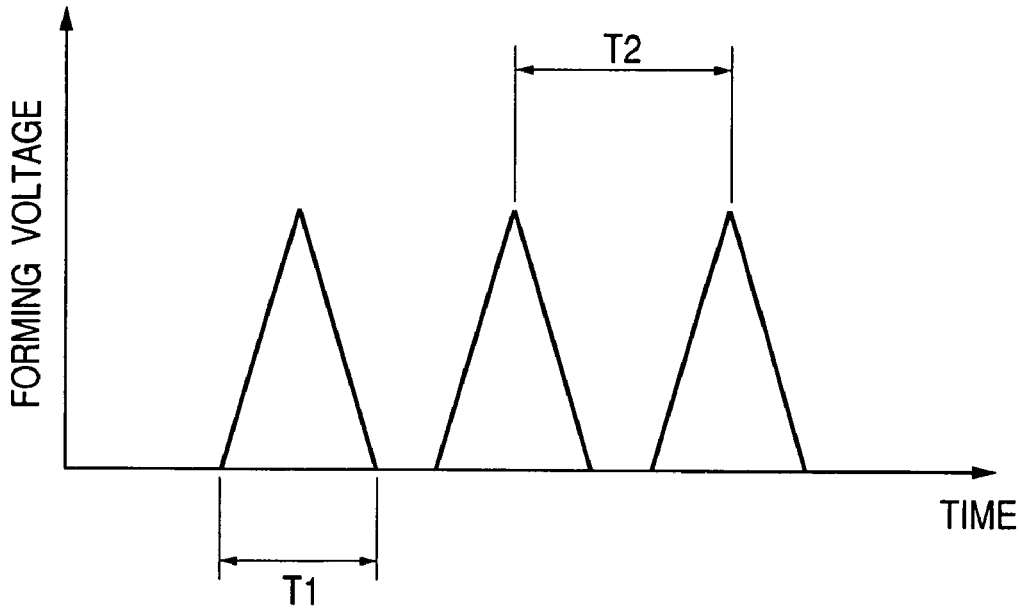
FIGS. 6A and 6B are diagrams showing examples of voltage waveforms used in energization processing in forming.
Figure 6B:
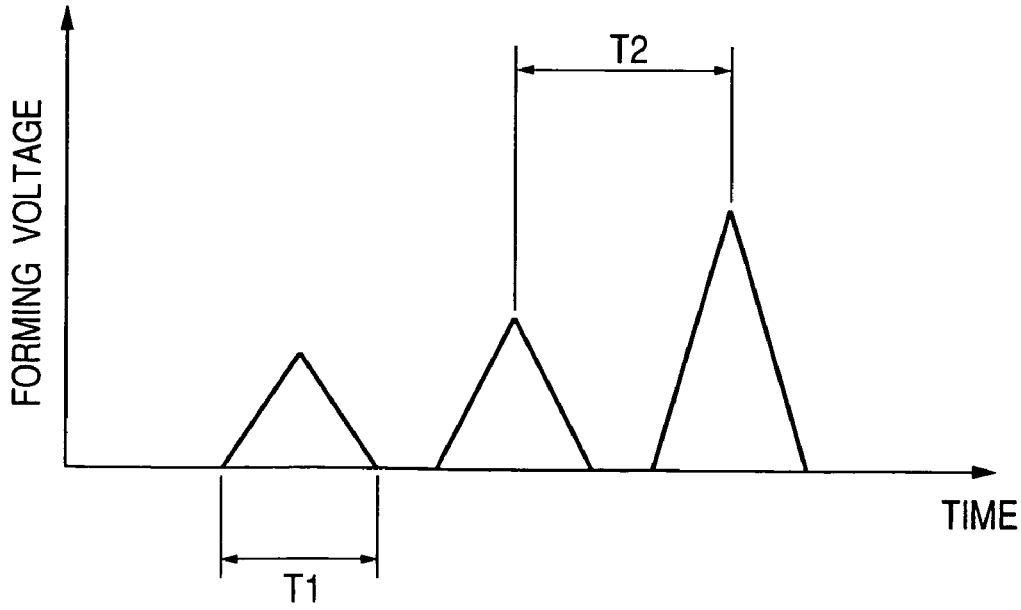

FIGS. 6A and 6B are diagrams of examples of voltage waveforms used in energization processing in forming.

A pulse waveform is often used for an application voltage, and there may be a case where a pulse is applied while a pulse peak value is kept at a constant voltage (FIG. 6A) and a case where a pulse is applied while a pulse peak value is increased (FIG. 6B).

In FIG. 6A, T1 and T2 indicate a pulse width and a pulse interval of a voltage waveform. For example, T1, T2, and a peak value of a triangular wave (peak voltage at the time of forming) are appropriately selected in accordance with a design of the electron-emitting device to conduct pulse application.

In FIG. 6B, the sizes of T1 and T2 are the same as in FIG. 6A, and the peak value of a triangular wave (peak voltage at the time of forming) is increased by, for example, 0.1V.

Note that the completion of forming processing is determined by the completion of forming or the like at the point of time, for example, the resistance 1000 times or more the resistance before forming processing is shown when the resistance value is obtained by inserting a voltage at a degree where the electroconductive film 4 is not locally broken and deformed, for example, a pulse voltage of about 0.1V between forming pulses and measuring a device current.

(G) Activation

As described above, the electroconductive film that has been subjected to only forming has extremely low electron generation efficiency. Thus, in order to raise electron emission efficiency, processing called activation is desirably conducted.

This is a process in which: as in the above-mentioned forming, a hood-shape lid is put on the substrate to form a vacuum space in the interior between the lid and the substrate, a pulse voltage is repeatedly applied to the device electrodes through the X wirings and Y wirings from an external power source, gas containing carbon atoms is introduced to deposit carbon or carbon compound that derives from the gas so as to form a carbon film with a gap in the fissure in the vicinity of the end portion of the electroconductive film which faces the fissure.

The preferable gas pressure of an organic substance is appropriately set as the occasion demands because it depends on the form of the device, the shape of the vacuum container, the kind of the organic substance, and the like.

As the suitable organic material, there are exemplified aliphatic hydrocarbons such as alkanes, alkenes, and alkynes; aromatic hydrocarbons; alcohols; aldehydes; ketones; amines; phenol; organic acids such as carboxylic acid, sulfonic acid etc. Specifically, saturated hydrocarbons such as methane, ethane, and propane, which are represented by the compositional formula $C_nH_{2n+2}$; unsaturated hydrocarbons such as ethylene and propylene, which are represented by the compositional formula $C_nH_{2n}$; benzene; toluene; methanol; ethanol; formaldehyde; acetaldehyde; acetone; methylethyl ketone; methylamine; ethylamine; phenol; formic acid; acetic acid; propionic acid; benzonitrile; trinitrile; acetylene, etc. may be used.

An activation voltage $V_{act}$ is applied between the device electrodes 2 and 3 in an atmosphere containing the above-mentioned organic substance gas, whereby the carbon or carbon compound from the organic substance existing in the atmosphere is deposited on the devices, and a device current If and an emission current Ie are markedly changed. The activation voltage $V_{act}$ is also appropriately set depending on the form of the device, the shape of the vacuum container, the kind of the organic substance, and the like. However, the activation voltage $V_{act}$ is set to have a value larger than that of a forming voltage $V_{form}$, and the pulse width and the pulse interval are appropriately set. Note that, in the case of "high voltage activation" in which the activation voltage $V_{act}$ is set larger than the forming voltage $V_{form}$, for example, the activation voltage is set 1.5 times or more the forming voltage, there is a fear that a device discharge occurs in activation. However, by desirably controlling the fissure of the conductive film according to the present invention, a discharge can be avoided even with a high voltage activation process. Note that by conducting high voltage activation, the electron-emitting device characteristic with high efficiency can be obtained, and also, an activation time can be shortened.

The determination of the completion of the activation process can be appropriately made while the device current If and/or the emission current Ie is measured. Further, these processes may be conducted while the substrate is heated.

Figure 9A:
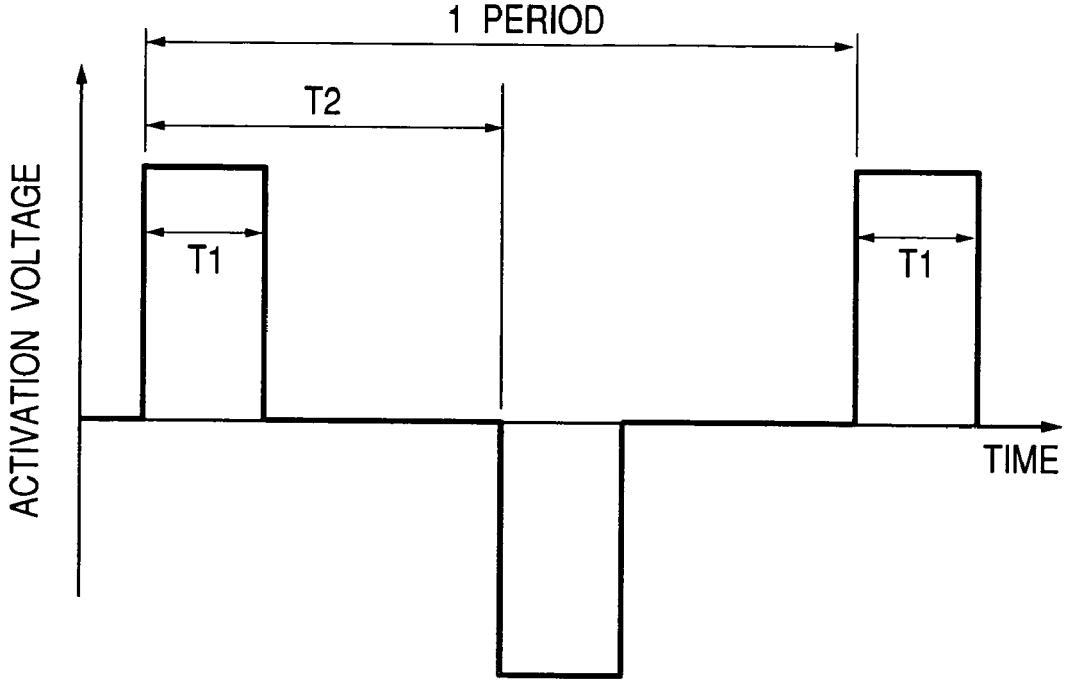
FIGS. 9A and 9B are diagrams showing examples of voltage waveforms used in an activation process.
Figure 9B:
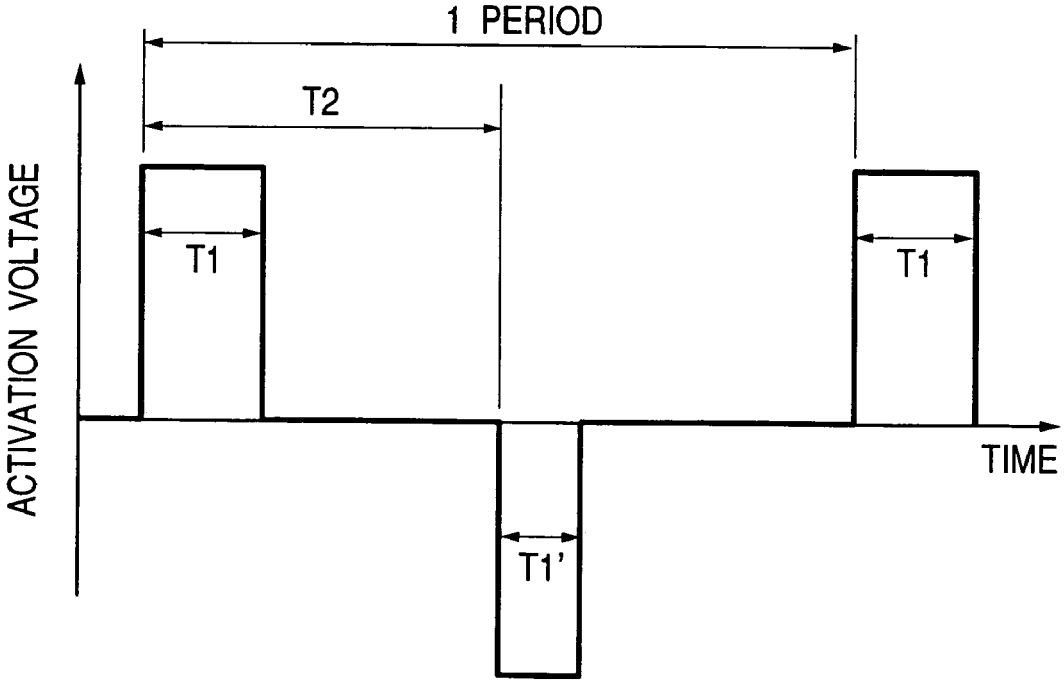

FIGS. 9A and 9B show preferred examples of voltage application used in the activation process. The value of the maximum voltage to be applied is appropriately selected in accordance with the design of the device. In FIG. 9A, T1 indicates a positive or negative pulse width of a voltage waveform, T2 indicates a pulse interval, and the voltage value is set such that the positive and negative absolute values are equal to each other. Further, in FIG. 9B, T1 and T1' respectively indicate positive and negative pulse widths of a voltage waveform, T2 indicates a pulse interval, T1>T1' is satisfied, and the voltage value is set such that the positive and negative absolute values are equal to each other.

At this time, a voltage imparted to the device electrodes 23 is positive, and the device current If has a positive direction in which the current flows from the device electrodes 23 to the device electrodes 22. Energization is stopped when the emission current Ie substantially reaches a saturation point, and a slow leak valve is turned off. Thus, the activation process is completed.

Through the above-mentioned processes, there can be obtained the electron source substrate having the electron-emitting devices of the present invention.

Further, the electron-emitting devices obtained through the above-mentioned processes are preferably subjected to a stabilization process. This is a process of exhausting an organic substance in a vacuum container. As to a vacuum exhaust apparatus for exhausting the vacuum container, one without using oil is preferably used such that the device characteristic is not influenced by the oil generated from the apparatus. Specifically, there can be given vacuum exhaust apparatuses such as a sorption pump and an ion pump.

In the case where, in the activation process, an oil diffusion pump or a rotary pump is used as the exhaust apparatus, and the organic gas that derives from the oil ingredient to be generated is used, it is necessary to suppress the partial pressure of the ingredient as low as possible. The partial pressure of the organic ingredient in the vacuum container is at a level that the carbon or carbon compound is not substantially deposited anew and is preferably $10^{-6}$ Pa or less, and more preferably $10^{-8}$ Pa or less. Further, when the interior of the vacuum container is exhausted, it is preferable that the whole vacuum container is heated to make it easy that the inner wall of the vacuum container and the organic substance molecules that adsorb to the electron-emitting devices are exhausted. Heating at this time is conducted preferably at 80 to 300° C., and more preferably 200° C., and also, for the longest time possible. However, the present invention is not particularly limited to the above-mentioned conditions. Heating is conducted under the conditions appropriately selected from the various conditions such as the size and shape of the vacuum container, and the structure of the electron-emitting device. The pressure in the vacuum container needs to be lowered as much as possible, and is preferably $10^{-5}$ Pa or less, and more preferably, $10^{-6}$ Pa or less.

As to the atmosphere at the time of driving after the stabilization process, the atmosphere at the time of the completion of the stabilization process is preferably kept, but the present invention is not limited to this. As long as the organic substance is sufficiently removed, a sufficient stable characteristic can be maintained even with the little rise of the pressure itself. The above-mentioned vacuum atmosphere is adopted, whereby new deposition of carbon or carbon compound can be suppressed. As a result, the device current If and the emission current Ie are stabilized.

(Basic Characteristic)

The basic characteristic of the electron-emitting device of the present invention, which is formed in accordance with the device structure and the manufacturing method as described above, will be described with reference to FIGS. 7 and 8.

Figure 7:
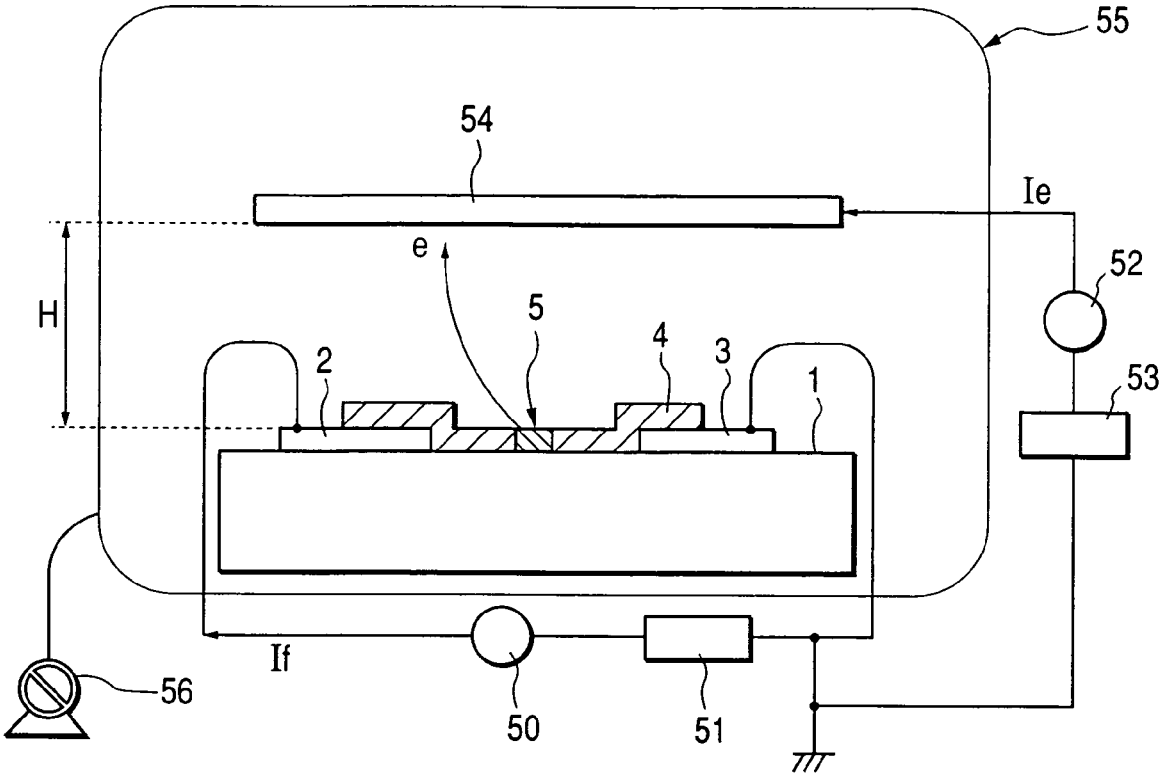
FIG. 7 is a schematic diagram of a measurement evaluation apparatus for measuring a characteristic of an electron-emitting device.

FIG. 7 is a schematic diagram of a measurement evaluation apparatus for measuring the electron-emitting characteristic of the electron-emitting device having the above-mentioned structure.

In FIG. 7, reference numeral 1 denotes a glass substrate, 2 and 3 denote device electrodes, 4 denotes an electroconductive film provided with an electron-emitting portion including a fissure, and 5 denotes an electron-emitting portion. Further, reference numeral 51 denotes a power source for applying a device voltage Vf to a device, 50 denotes an ammeter for measuring a device current If flowing through the electroconductive film 4 including the electron-emitting portion between the device electrodes 2 and 3, 54 denotes an anode electrode for capturing an emission current Ie of electrons emitted from the electron-emitting portion of the electron-emitting device, 53 denotes a high voltage power source for applying a voltage to the anode electrode 54, and 52 denotes an ammeter for measuring the emission current Ie.

The power source 51 and the ammeter 50 are connected to the device electrodes 2 and 3 in order to measure the device current If flowing between the device electrodes of the electron-emitting device and the emission current Ie to the anode, and the anode electrode 54 connected to the high voltage power source 53 and the ammeter 52 is arranged above the electron-emitting device.

Further, the electron-emitting device of the present invention and the anode electrode 54 are provided in a vacuum apparatus, and the vacuum apparatus is provided with devices necessary for the vacuum apparatus, such as a vacuum container 55, a vacuum pump 56, and a not-shown vacuum gauge. The measurement evaluation of the electron-emitting device characteristic can be conducted under a desired vacuum atmosphere.

Figure 8:
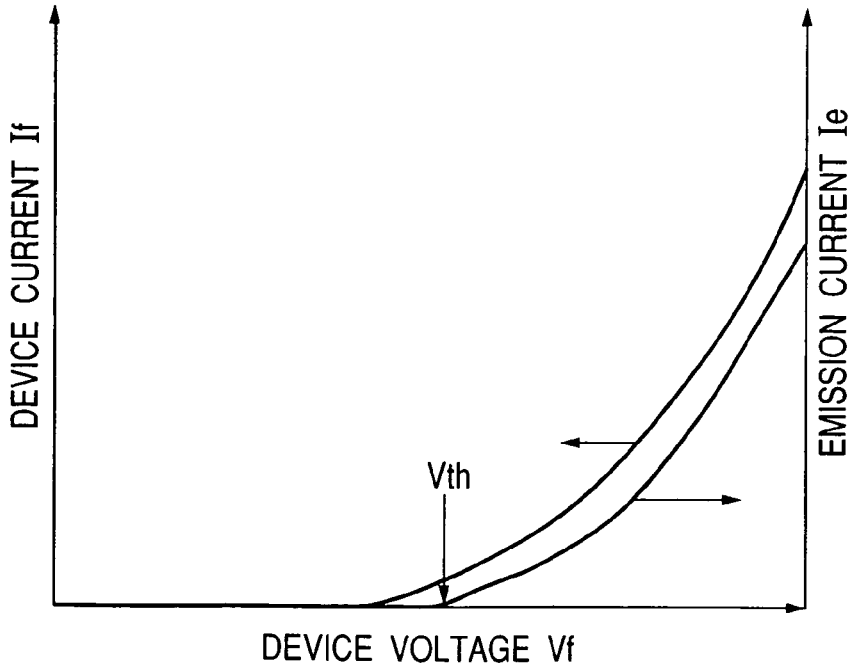
FIG. 8 is a diagram showing a typical example of the relationship among an emission current Ie and a device current If which are measured by the measurement evaluation apparatus shown in FIG. 7 and a device voltage Vf.

FIG. 8 shows a typical example of the relationship among the emission current Ie and the device current If which are measured by the measurement evaluation apparatus shown in FIG. 7 and the device voltage Vf. Note that the emission current Ie and the device current If remarkably differ in size, but a vertical axis is indicated by an arbitrary unit with a linear scale for qualitative comparison and consideration of the changes of If and Ie in FIG. 8.

The electron-emitting device according to the present invention has three characteristics with respect to the emission current Ie.

First, as apparent from FIG. 8, in the electron-emitting device according to the present invention, when a device voltage equal to or larger than a certain voltage (called threshold voltage, Vth in FIG. 8) is applied, the emission current Ie sharply increases while the emission current Ie is hardly detected at the threshold voltage Vth or lower. That is, it is found that there is shown a characteristic peculiar to a non-linear element having the definite threshold voltage Vth with respect to the emission current Ie.

Secondly, since the emission current Ie depends on the device voltage Vf, the emission current Ie can be controlled in accordance with the device voltage Vf.

Thirdly, the emission charge captured by the anode electrode 54 depends on the time for applying the device voltage Vf. That is, the amount of the charge captured by the anode electrode 54 can be controlled in accordance with the time for applying the device voltage Vf.

(Electron Beam Apparatus, Display Device)

<Seal Bonding—Forming a Panel>

Examples of an electron beam apparatus and a display device using the above-mentioned electron source with a simple matrix arrangement will be described with reference to FIG. 10.

Figure 10:
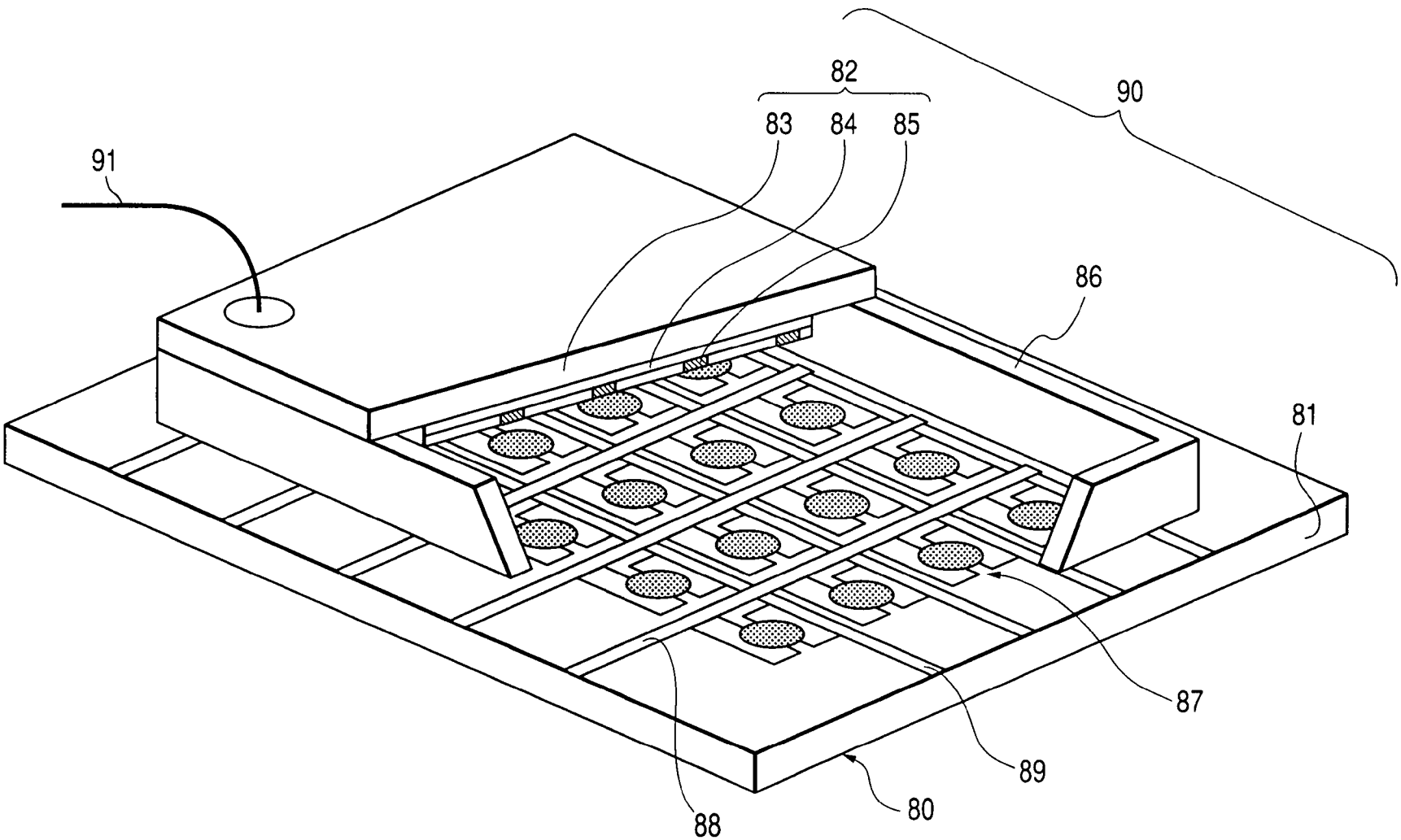

In FIG. 10, reference numeral 80 denotes an electron source substrate on which a large number of electron-emitting devices are arranged, and reference numeral 81 denotes a glass substrate, which is referred to as a rear plate in the description. Reference numeral 82 denotes a face plate in which a fluorescent film 84 and a metal back 85 are formed on the inner surface of a glass substrate 83. Reference numeral 86 denotes a support frame. The rear plate 81, the support frame 86, and the face plate 82 are adhered to each other by frit glass. A method such as baking is conducted thereto at 400 to 500° C. for 10 minutes or more to conduct seal bonding to those components, thereby being capable of constituting an envelope 90.

This series of processes is all conducted in a vacuum container, whereby the interior of the envelope 90 can be kept in vacuum from the beginning, and also, the processes can be made simple.

In FIG. 10, reference numeral 87 denotes electron-emitting devices of the present invention. Reference numerals 88 and 89 denote an X directional wiring and a Y directional wiring each of which are connected to a pair of device electrodes of the electron-emitting device.

On the other hand, not-shown support bodies called spacers are arranged between the face plate 82 and the rear plate 81 at appropriate intervals. Thus, even in the case of a large-area panel, the envelope 90 having a sufficient strength with respect to an atmospheric pressure can be structured.

Figure 11A:
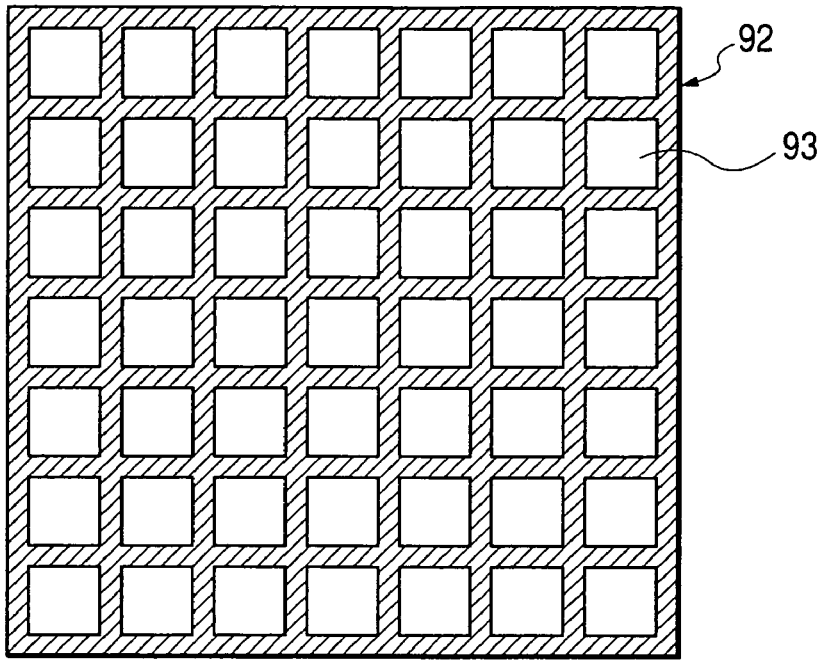
FIGS. 11A and 11B are plan views showing an example of an embodiment of a fluorescent film provided on a face plate.
Figure 11B:
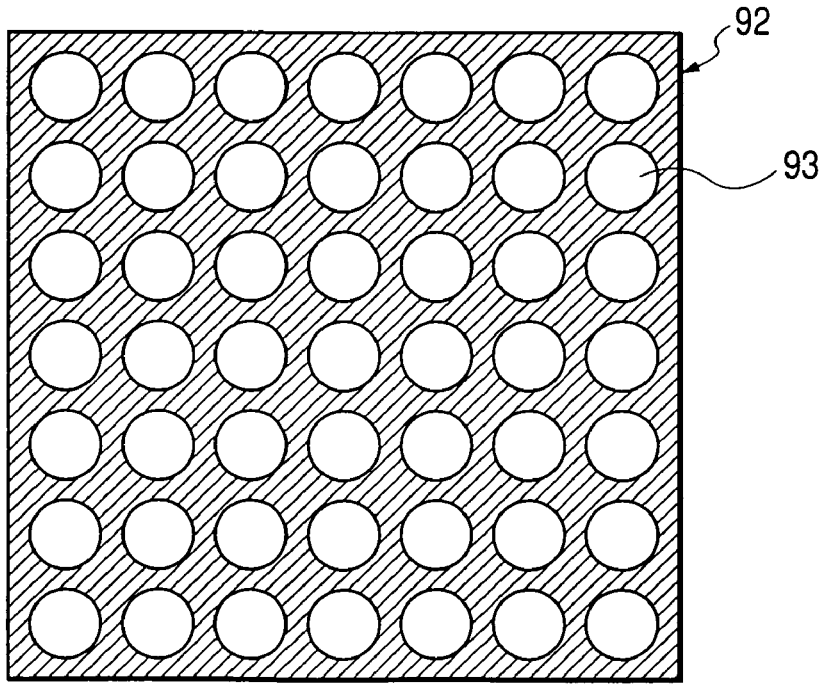

FIGS. 11A and 11B are explanatory diagrams of the fluorescent film provided on the face plate.

The degree of vacuum at the time of seal bonding needs to be about $1.3\times10^{-5}$ Pa. In addition, there may be a case where getter processing is conducted in order to keep the degree of vacuum after seal of the envelope 90. This is processing in which immediately before sealing of the envelope 90 or after sealing, a getter arranged at a predetermined position (not shown) in the envelope is heated by a heating method such as resistance heating or high frequency heating, thereby forming an evaporated film. The getter generally contains Ba or the like as a main ingredient, and keeps a degree of vacuum of, for example, $1.3\times10^{-3}$ to $1.3\times10^{-5}$ Pa by an adsorption action of the evaporated film.

<Display Device>

According to the above-mentioned basic characteristic of the electron-emitting device of the present invention, emission electrons from the electron-emitting portion are controlled in accordance with a peak value and a width of a pulse voltage applied between the opposing device electrodes at a threshold voltage or more, and a current amount is controlled by an intermediate value thereof. Thus, a halftone display is enabled.

Further, in the case where a large number of electron-emitting devices are arranged, a selection line is determined in accordance with a scanning line signal of each line. When the pulse voltage is appropriately applied to each device through each information signal line, a voltage can be appropriately applied to an arbitrary device, and thus, each device can be turned on.

Further, as a system of modulating an electron-emitting device in accordance with an input signal having a halftone, there can be given a voltage modulation system and a pulse width modulation system.

Figure 12:
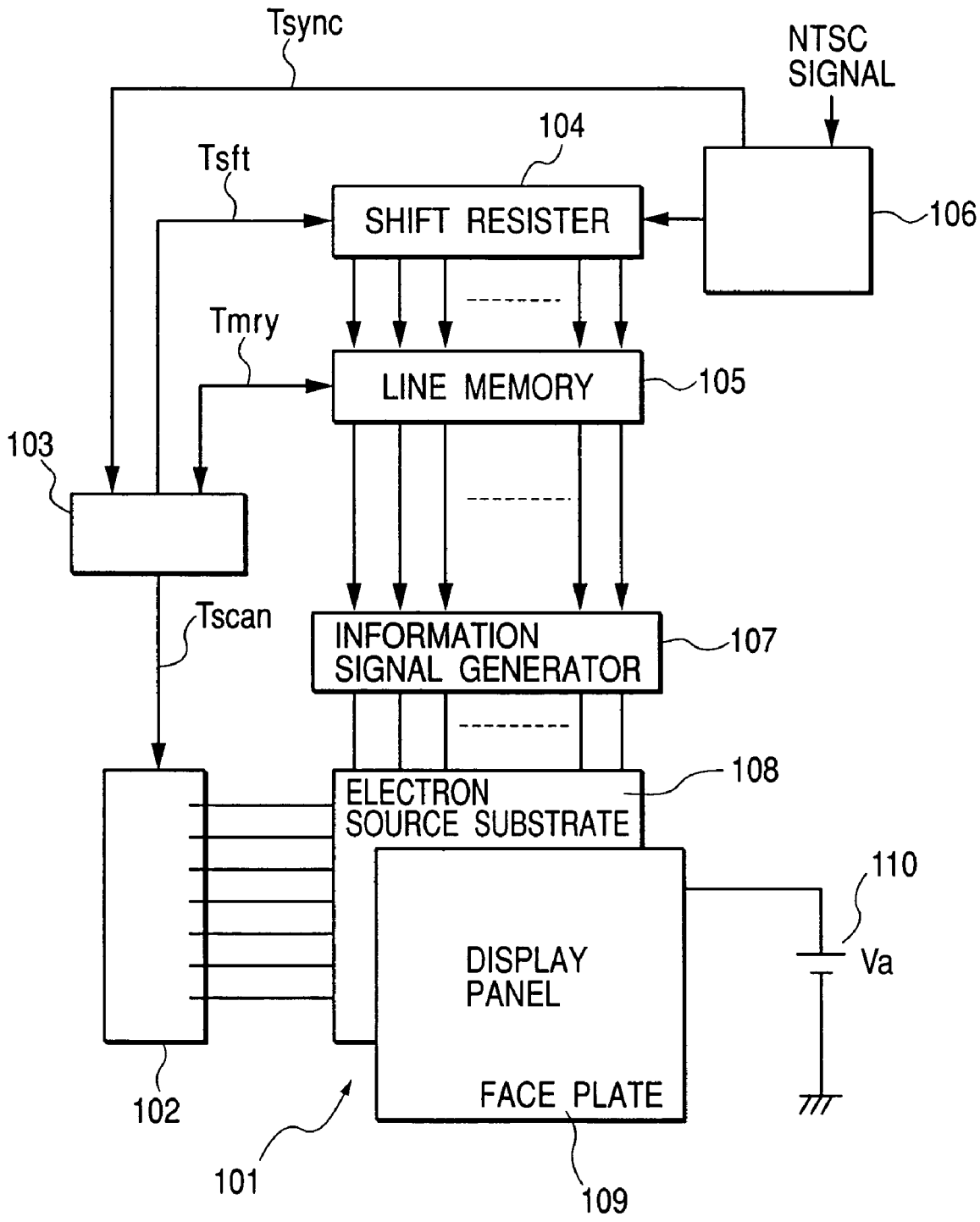
FIG. 12 is a conceptual diagram showing an example of a display apparatus driven by an image signal of an NTSC system.

FIG. 12 is a conceptual diagram of an example of a display device driven by an image signal of a national television system committee (NTSC) system.

In FIG. 12, reference numeral 101 denotes an image display panel, 102 denotes a scan circuit, 103 denotes a control circuit, 104 denotes a shift resister, 105 denotes a line memory, 106 denotes a synchronizing signal separating circuit, 107 denotes an information signal generator, and reference symbols Vx and Va denote direct-current voltage sources.

The scan circuit 102 for applying the scanning line signal and the information signal generator 107 applied with the information signal are connected with the X directional wiring and the Y directional wiring, respectively, of the display panel 101 using the electron-emitting devices.

DESCRIPTION OF THE PREFERRED EMBODIMENTS

The present invention will be described specifically based upon examples hereinbelow. However, the present invention is not limited to these examples.

EXAMPLE 1

(A) Formation of Device Electrode

This example employed glass of PD-200 (manufactured by ASAHI GLASS CO., LTD.) containing a little alkaline ingredient which has a thickness of 2.8 mm and a size of 350×300 (mm). Further, the glass was used after coating and baking thereon 100 nm of an $SiO_2$ film as a sodium blocking layer.

In addition, device electrodes 22 and 23 were formed on a glass substrate 21 by the following process. That is, by sputtering, a film of titanium (Ti) having a thickness of 5 nm was first formed as a base layer and a film of platinum (Pt) having a thickness of 40 nm was formed thereon. Thereafter, a photo resist was applied and patterning was conducted by photolithography including a series of steps, exposure, development, and etching.

In this example, an interval L between the device electrodes was 10 μm and W thereof was 100 μm.

(B) Formation of Y Directional Wiring

A Y directional wiring as a common wiring was formed with a linear pattern so as to contact one of the device electrodes and couple each one thereof. Silver (Ag) photo paste ink was used as a material and subjected to: screen printing; then drying; exposure into a predetermined pattern; and development. Thereafter, baking was conducted at a temperature of approximately 480° C. to form the wiring.

The wiring has a thickness of 10 μm and a width of 50 μm. Note that a terminal portion thereof was made larger in line width so as to be used as a wiring lead-out electrode.

(C) Formation of Insulating Film

In order to establish insulation between upper and lower wirings, the insulating film is arranged. A contact hole is opened in a connection portion so as to cover at least an intersecting portion of the X directional wiring described below and the Y directional wiring that is previously formed under the X directional wiring and so as to enable electrical connection between the upper wiring and the device electrodes of the another kind.

In this process, screen printing was conducted on photosensitive glass paste containing PbO as a main ingredient, and then subjected to exposure and development. This process was repeated four times. Lastly, baking was conducted at a temperature of approximately 480° C. The interlayer insulating layer thus formed has an overall thickness of about 30 μm and a width of 150 μm.

(D) Formation of X Directional Wiring

An X directional wiring was formed in the following process. That is, on the insulating film previously formed, Ag paste ink was subjected to screen printing and then dried. On the processed Ag paste ink, the same process was conducted again, so that coating was conducted twice. Then, baking was conducted at a temperature of approximately 480° C. The X directional wiring intersects the Y directional wiring while sandwiching the above-mentioned insulating film therebetween, and is connected to the other of the device electrodes at a contact hole portion of the insulating film.

The other of the device electrodes is coupled by this wiring. In the case of a display panel, the device electrodes act as scanning electrodes.

The X directional wiring has a thickness of about 15 μm. A lead-out wiring to an external driver circuit was also formed in the same manner.

Although not shown, a lead-out terminal to the external driver circuit was also formed in the same manner.

Thus, a matrix substrate was formed in which a pixel pitch was 290×650 (μm) and the number of devices was 720×240.

(E) Formation of Electroconductive Film

The matrix substrate formed as described above was sufficiently cleaned, and then a surface of the substrate was exposed to an atmosphere containing silane-coupling-repellent so as to have hydrophobic property. At this time, a contact angle of a surface water of the substrate was 50° to 60°.

Subsequently, an electroconductive film composing an electron emission portion was formed between the electrodes. First, in an aqueous solution in which partially saponified polyvinyl alcohol (degree of saponification: 88%) and isopropanol were dissolved such that concentrations thereof were 0.05 wt % and 15 wt %, respectively, ethylene glycol (EG) and a palladium-proline complex were dissolved such that concentrations thereof were 2.0 wt % and 0.10Pd wt %, respectively, thereby preparing an yellow solution.

By using as a liquid drop applying means 7 an ink jet apparatus of a piezoelectric element method using a piezoelectric element, a liquid drop of the above-mentioned aqueous solution was applied between the device electrodes formed at Process (a) four times at an interval of 7 seconds between the respective liquid drop applying processes. At this time, the temperature was 23° C. and humidity was 47%.

The sample substrate prepared at the above-mentioned process was baked in the atmosphere at 350° C. for 30 minutes.

Thus, the electroconductive film with a fine particle structure including PdO was formed.

A film thickness distribution approximately along a fissure direction of the electroconductive film which is obtained by an electron probe X-ray microanalyzer (EPMA) measurement method was in a range of 6.5 to 7.2 nm and was provided with an excellent uniformity (excepting both end portions thereof each being 5 μm).

<Description of EPMA Measurement Method>

Using "EPMA-810" manufactured by Shimadzu Corporation, an accelerating voltage is set to a value equal to or larger than a value at which the PdO film thickness can be sufficiently transmitted through (set to 15 kV in this experiment), scanning was conducted several times along the direction of the fissure to be formed later, and the count number of Pd among the PdO electroconductive film was measured. This measurement was conducted for the PdO films of various thicknesses, and thereafter, the actual film thicknesses are measured by using an atomic force microscope (AFM) ("VZ7700" manufactured by KEYENCE CORPORATION) and "Alpha-Step 500" manufactured by KLA-Tencor Corporation, thereby obtaining a correlation between the count number of Pd and the film thicknesses.

Measurement of the film thickness of the electroconductive film as a panel sample is actually conducted with the EPMA method, thereby eliminating even a problem in that measurement of a contact type is difficult due to the wirings or electrodes that are patterned with a high definition.

With respect to this sample, Process (f), that is a forming process, Process (g), that is an activation process, and a stabilization process were conducted as follows.

The above-mentioned substrate was held within the vacuum chamber under reduced pressure and heated to 90° C. At this time, a resistance of the electro conductive film was 12 kΩ per device.

Under a forming voltage of 12V, a circuit corresponding to a scan circuit 102 of FIG. 12 was switched sequentially to scan whole lines, so that a voltage applied to each line had a rectangular wave as shown in FIGS. 6A and 6B and the pulse in which T1=0.1 ms and T2=50 ms was applied thereto.

In this state, a mixture gas of 2% $H_2$ and 98% $N_2$ was introduced into the chamber at a pressure increase rate of 5000 Pa per minute to reduce the electroconductive film. In the electroconductive film, a forming fissure was formed as the reduction progressed. After 10 minutes, the resistances of the electroconductive films of the whole lines were increased to 1 MΩ or more. Thus, the electron emission portion including the fissure in a central portion of the electroconductive film was formed.

Subsequently, air within the chamber was exhausted using a vacuum pump. After the interior pressure became approximately $1\times10^{-6}$ Pa, tolunitrile vapor was introduced under partial pressure of $1.1\times10^{-4}$ Pa, a pulse voltage was applied thereto while maintaining the substrate temperature at 90° C., and activation was conducted for 60 minutes. Thus, at least at the end portion of the electroconductive film facing the fissure, the film having a gap and containing carbon as a main ingredient was formed.

A rectangular pulse at 18V and 1 ms and a rectangular pulse at −18V and 1 ms were applied at 100 Hz in turn. When an increasing state of a device current during the activation process was observed, uniform increase of the current over the whole conductive films could be seen to become saturated at approximately 660 mA per line (720 devices).

Thereafter, the stabilization process was conducted under $2\times10^{-8}$ Pa at 300° C. for 5 hours.

The electron source substrate thus obtained was set within the vacuum container of the measurement evaluation apparatus, and If and Ie were measured when a drive voltage Vf=16V (an anode voltage Va=1 kV/2 mm) with respect to 10 lines×120=1200 of devices, which resulted in the devices with an extremely excellent efficiency per device where If 0.88 to 0.93 mA, Ie=2.04 to 2.19 μA, the efficiency (Ie/If) =0.23%, and a variation of Ie is approximately 7%. In addition, similar drive (at 60 Hz, 30 μs, and 16V) was conducted for 1 hour with respect to 50 lines×720=36000 of devices, and thereafter, the substrate was taken out from the vacuum container to make observation through microscopy. As a result, a pixel with fissure damage or damage due to electric discharge could not be observed.

Also, this sample substrate was cut into such a size that a scanning electron microscope (SEM) observation measurement was possible (10 square mm), thereby making observation with respect to the fissure portion of each of 5 devices obtained from 1 line, that is, 50 devices in total. As a result, a size of the gap of the film containing carbon as a main ingredient was within a range of several nm to 40 nm, and a fissure width of the conductive film (Pd in this device) located in an outside thereof (a side closer to the device electrode) was 200 nm to 380 nm in the device with a minimum width and 280 nm to 530 nm in the device with a maximum width, which was a substantially uniform fissure condition. Also, there was no branching in the fissures of these conductive films.

EXAMPLES 2 TO 6 AND COMPARATIVE EXAMPLES 1 TO 5

Each electron-emitting device was prepared in the same manner as in Example 1 except that, at Process (e) of Example 1, an interval between the respective liquid drop-applying processes ("Time interval" in Table 1), a weight concentration of palladium, and a weight concentration of ethylene glycol (EG) were set as shown in Table 1.

TABLE 1

| Palladium concen-tration | EG concen-tration | Time interval 2 sec | 7 sec | 12 sec |
|---|---|---|---|---|
| 0.10 wt % | 0 wt % | | Comparative Example 1 | |
| | 1.0 wt % | Example 2 | | |
| | 2.0 wt % | Comparative Example 2 | (Example 1) | Example 3 |
| 0.12 wt % | 2.0 wt % | | Example 4 | Example 5 |
| 0.15 wt % | 1.5 wt % | Comparative Example 3 | | |
| | 2.0 wt % | | Example 6 | Comparative Example 4 |
| 0.20 wt % | 2.0 wt % | | Comparative Example 5 | |

Table 2 shows shapes and device film thicknesses (between the device electrodes, along a parallel direction of the electrodes, and excepting both end portions thereof each being 5 μm) of the conductive films of these substrates obtained with the EPMA measurement method.

TABLE 2

| Palladium concen-tration | EG concen-tration | Time interval 2 sec | 7 sec | 12 sec |
|---|---|---|---|---|
| 0.10 wt % | 0 wt % | | Extremely concave 1.5 to 10 nm | |
| | 1.0 wt % | Approx. uniform (a little convex) 5.1 to 8.2 nm | | |
| | 2.0 wt % | Considerably convex 3.4 to 12.1 nm | Approx. uniform 6.5 to 7.2 nm | Approx. uniform (a little concave) 6.5 to 7.3 nm |
| 0.12 wt % | 2.0 wt % | | Approx. uniform 7.2 to 8.4 nm | Approx. uniform (a little concave) 7.0 to 8.6 nm |

TABLE 2-continued

| Palladium concen-tration | EG concen-tration | Time interval 2 sec | 7 sec | 12 sec |
|---|---|---|---|---|
| 0.15 wt % | 1.5 wt % | Considerably convex 7.1 to 14.2 nm | | |
| | 2.0 wt % | | Approx. uniform 8.1 to 9.9 nm | Concave to some extent 7.8 to 11.1 nm |
| 0.20 wt % | 2.0 wt % | | Approx. uniform (a little concave) 11.8 to 15.5 nm | |

Similarly to Example 1, the matrix substrate of the electron-emitting device thus obtained was set within a vacuum container of the measurement evaluation apparatus, and If and Ie were measured when a drive voltage Vf=16V (an anode voltage Va=1 kV/2 mm) with respect to 10 lines×120=1200 of devices. In addition, in a sample whose characteristics had been obtained to a certain degree, consecutive drive (at 60 Hz, 30 μs, and 16V) was conducted for 1 hour with respect to 10 to 50 lines×720=7200 to 36000 of devices, and thereafter, observation through microscopy was made. Table 3 shows the results (presence or absence of a pixel with fissure damage and damage due to electric discharge), where each value of If and Ie is an average value per device.

TABLE 3

| Palladium concen-tration | EG concen-tration | Time interval 2 sec | 7 sec | 12 sec |
|---|---|---|---|---|
| 0.10 wt % | 0 wt % | | Current leakage: large Ie: extremely small | |
| | 1.0 wt % | If = 0.88 mA Ie = 2.0 μA Electric discharge: OK | | |
| | 2.0 wt % | If = 0.85 mA Ie = 1.62 μA Electric discharge: occurs | If = 0.91 mA Ie = 2.1 μA Electric discharge: OK | If = 0.96 mA Ie = 2.3 μA Electric discharge: OK |
| 0.12 wt % | 2.0 wt % | | If = 0.95 mA Ie = 2.4 μA Electric discharge: OK | If = 0.96 mA Ie = 2.6 μA Electric discharge: OK |
| 0.15 wt % | 1.5 wt % | If = 0.88 mA Ie = 1.55 μA Electric discharge: occurs | | |
| | 2.0 wt % | | If = 0.94 mA Ie = 2.0 μA Electric discharge: OK | If = 0.65 mA Ie = 0.81 μA Electric discharge: occurs frequently |
| 0.20 wt % | 2.0 wt % | | Electric discharge: occurs frequently at activation | |

Note that "Electric discharge: OK" in Table 3 indicates the case where no electric discharge occurs or electric discharge of an extremely small magnitude occurs an extremely small number of times, as a result of which there occurs no damage due to electric discharge.

Also, similarly to Example 1, these sample substrates were cut into such a size that the SEM observation measurement was possible (10 mm□), thereby making observation with respect to the fissure portion of each of 5 devices obtained from 1 line, that is, 50 devices in total (several devices in part of the comparative examples). The results from the observation of conditions such as fissure widths and branching of the electroconductive films are shown below, where the upper value in each cell indicates device data with the minimum width and the lower value in each cell indicates device data with the maximum width.

TABLE 4

| Palladium concen-tration | EG concen-tration | Time interval 2 sec | 7 sec | 12 sec |
|---|---|---|---|---|
| 0.10 wt % | 0 wt % | | D<br>Central portion: no fissure | |
| | 1.0 wt % | A<br>350 to 620 nm<br>480 to 800 nm | (D)<br>Partially: no fissure<br>Peripheral portion: C | |
| | 2.0 wt % | B<br>30 to 220 nm<br>40 to 720 nm | A<br>200 to 380 nm<br>280 to 530 nm | A<br>250 to 450 nm<br>350 to 540 nm |
| 0.12 wt % | 2.0 wt % | | A<br>190 to 350 nm<br>260 to 510 nm | A<br>150 to 300 nm<br>290 to 560 nm |
| 0.15 wt % | 1.5 wt % | B<br>20 to 350 nm<br>20 to 880 nm | | |
| | 2.0 wt % | | A<br>60 to 350 nm<br>100 to 400 nm | C<br>30 to 550 nm<br>40 to 870 nm |
| 0.20 wt % | 2.0 wt % | | C<br>50 to 750 nm<br>20 to 900 nm | |

In Table 4, A, B, C, and D denote states of fissure forms and indicate the following conditions:

A denotes devices without branching nor extreme decrease or increase of the fissure width;

B denotes devices in part of which partial branching exists and in part of which there exist a portion with an extremely small width due to the Pd film remaining in an island-shape within the fissure and also an area with an extremely large fissure width conceivably due to weak electric discharge;

C denotes devices in most of which there exist partial branching, a portion with an extremely small width due to the Pd film remaining in an island-shape within the fissure, and also an area with an extremely large fissure width conceivably due to weak electric discharge; and D denotes devices whose fissures are not continuous but have breaks.

As a result of the fissure observation shown in Table 4, it was confirmed that the devices of the respective examples which had high resistance thereof to electric discharge and showed excellent electron source characteristics in Table 3, had no fissure or branching in the electroconductive film and had such substantially uniform fissure conditions that widths thereof were all 60 nm or more and 800 nm or less and differences between the maximum value and the minimum value of the fissure widths were 300 nm or less.

Also, in a process for forming the electroconductive film under completely the same conditions as in Comparative Example 1, Example 2, Comparative Example 2, Example 1, and Example 3, which varied in time interval between each liquid drop applying process with compositions having the Pd concentration of 0.1% by weight and the EG concentration of 0%, 1.0%, or 2.0% by weight, an amount of vaporized solvent in the liquid drop at the interval between each liquid drop applying process was measured with the following method.

First, a volume of the liquid drop at the interval of 0 second between each liquid drop applying process was calculated from the amount of the discharged liquid drop.

Also, the film under a condition that a solvent evaporation rate was 100%, that is, in a completely dried state was prepared after applying the liquid drop thereto by being subjected to heating in a clean oven at 200° C. for 30 minutes. Heating at 200° C. was conducted in order to eliminate the solvent contained in the solution that contains the ingredients of the electroconductive film, and in order not to decompose the other ingredients. The film in the completely dried state was measured by using the AFM ("VZ7700" manufactured by KEYENCE CORPORATION) and the "Alpha-Step 500" manufactured by KLA-Tencor Corporation and the actual film thickness and film volume were obtained. This measurement was conducted for the devices having a film thickness at ten-and-several levels, while by using an optical microscope, after standardizing light sources, transmitted light images were fetched and each transmitted light intensity ratio was obtained by using "WinRoof" which is an image processing software manufactured by MITANI CORPORATION. Based on the result, a correlation between the transmitted light intensity ratio and the film thickness and film volume was determined.

To obtain the solvent evaporation rate at the interval between each liquid drop applying process, the optical microscope was seated so as to be able to observe the applied liquid drop in real time, a transmitted light image at each interval of 2 seconds, 7 seconds, and 12 seconds between the liquid drop applying process was fetched, and the transmitted light intensity ratio was similarly obtained to determine the volume of the liquid drop.

The amounts of the remaining solvent were obtained with the above-mentioned measurement, and the solvent evaporation rates were thus obtained as shown in Table 5.

TABLE 5

| Palladium concen-tration | EG concen-tration | Time interval 2 sec | 7 sec | 12 sec |
|---|---|---|---|---|
| 0.10 wt % | 0 wt % | | 99.4 wt % | |
| | 1.0 wt % | 96.0 wt % | | |
| | 2.0 wt % | 90.5 wt % | 96.8 wt % | 98.8 wt % |

Thus, it was confirmed that in the devices of the examples which achieved the target fissure condition, evaporation of the solvent contained in the solution that contains the ingredients of the electroconductive film between each of the liquid drop applying process was controlled to be conducted within a range of 96 wt % or more and 99 wt % or less.

As has been described above, manufacturing the electron-emitting device according to the present invention makes it possible to suppress the electric discharge of the device and to obtain the electron-emitting device, electron source substrate, and electron beam apparatus which have the extremely high efficiency. As a result, the display device with high display quality can also be obtained.

What is claimed is:

1. A method of manufacturing an electron-emitting device comprising: a pair of facing electrodes formed on a substrate; an electroconductive film having a fissure arranged between the pair of electrodes; and at least a film having a gap and containing carbon as a main ingredient, arranged at an end portion of the electroconductive film facing the fissure, the method comprising: at least a liquid drop applying process for liquid drop-applying electroconductive film ingredient-containing liquid containing the ingredient of the electroconductive film, wherein in the liquid drop applying process, the liquid drop-applying is conducted a plurality of times for one portion one after another, and wherein at every interval between respective performances of the liquid drop-applying, 96 wt % to 99 wt % based on 100 wt % of a solvent contained in a liquid drop is evaporated.

* * * * *